US006837562B2

(12) United States Patent
Nunokawa

(10) Patent No.: US 6,837,562 B2
(45) Date of Patent: Jan. 4, 2005

(54) PRINTING APPARATUS AND PRINTING METHOD

(75) Inventor: Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

(21) Appl. No.: 10/353,087

(22) Filed: Jan. 29, 2003

(65) Prior Publication Data

US 2003/0174180 A1 Sep. 18, 2003

(30) Foreign Application Priority Data

Feb. 4, 2002 (JP) ..... 2002-027112
Feb. 4, 2002 (JP) ..... 2002-027113

(51) Int. Cl.[7] ..... B41J 29/38; B41J 29/393
(52) U.S. Cl. ..... 347/14; 347/19; 358/1.15
(58) Field of Search ..... 347/5, 50, 54, 347/59, 14, 19

(56) References Cited

U.S. PATENT DOCUMENTS 5,610,635 A * 3/1997 Murray et al. ..... 347/7
5,930,553 A * 7/1999 Hirst et al. ..... 399/8
6,559,973 B2 * 5/2003 Bullock et al. ..... 358/1.8
6,655,779 B2 * 12/2003 Usui et al. ..... 347/19
2002/0118243 A1 * 8/2002 Forman ..... 347/19
2003/0016259 A1 * 1/2003 Otokita ..... 347/14

* cited by examiner

*Primary Examiner*—Stephen D. Meier
*Assistant Examiner*—Alfred Dudding

(57) ABSTRACT

It is an object of the invention to achieve a printing apparatus and the like that can provide a user with a print control program through an ink container, a printing medium, or a print head. The printing apparatus includes an ink container for containing ink, a printing medium capable of being printed with the ink of the ink container, and a print head for ejecting ink to the printing medium, where at least one of the ink container, the printing medium, and the print head can be attached/removed to/from a printing apparatus unit together with a memory, and on the memory is stored an acquisition program for acquiring, via the communications line, a print control program for printing on the printing medium by ejecting ink from the print head based on image data, or is stored the print control program.

18 Claims, 31 Drawing Sheets

PRINT HEAD A

| | | TYPE OF PAPER | | |
|---|---|---|---|---|
| | | α | β | γ |
| TYPE OF INK | a | P1 | P2 | P3 |
| | b | P2 | P2 | P3 |
| | c | P3 | P3 | P3 |

FIG. 12

| TYPE OF PRINT-CONTROL PROGRAM | RASTERIZING PROGRAM | RASTER-ROW CONVERSION PROGRAM |
|---|---|---|
| P1 | ① | ① |
| P2 | ② | ① |
| P3 | ③ | ① |

FIG. 13

PRINT HEAD B

| | | TYPE OF PAPER | | |
|---|---|---|---|---|
| | | α | β | γ |
| TYPE OF INK | a | P2 | P3 | P4 |
| | b | P3 | P3 | P4 |
| | c | P4 | P4 | P4 |

FIG. 16

| TYPE OF PRINT-CONTROL PROGRAM | RASTERIZING PROGRAM | RASTER-ROW CONVERSION PROGRAM |
|---|---|---|
| P1 | ① | ① |
| P2 | ② | ① |
| P3 | ③ | ① |
| P4 | ④ | ① |

FIG. 17

PRINT HEAD A

| | | TYPE OF PAPER | | |
|---|---|---|---|---|
| | | $\alpha$ | $\beta$ | $\gamma$ |
| TYPE OF INK | a | P1 | P2 | P3 |
| | b | P2 | P2 | P3 |
| | c | P3 | P3 | P3 |

FIG. 27

| TYPE OF PRINT-CONTROL PROGRAM | RASTERIZING PROGRAM | RASTER-ROW CONVERSION PROGRAM |
|---|---|---|
| P1 | ① | ① |
| P2 | ② | ① |
| P3 | ③ | ① |

FIG. 28

PRINT HEAD B

| | | TYPE OF PAPER | | |
|---|---|---|---|---|
| | | α | β | γ |
| TYPE OF INK | a | P2 | P3 | P4 |
| | b | P3 | P3 | P4 |
| | c | P4 | P4 | P4 |

FIG. 29

| TYPE OF PRINT-CONTROL PROGRAM | RASTERIZING PROGRAM | RASTER-ROW CONVERSION PROGRAM |
|---|---|---|
| P1 | ① | ① |
| P2 | ② | ① |
| P3 | ③ | ① |
| P4 | ④ | ① |

FIG. 30

PRINTING APPARATUS AND PRINTING METHOD

CROSS-REFERENCE TO RELATED APPLICATIONS

The present application claims priority on Japan Patent Application No. 2002-027112 and Japan Patent Application No. 2002-027113, filed on Feb. 4, 2002, and both of these applications are incorporated herein by reference.

BACKGROUND OF THE INVENTION

1. Field of the Invention

The present invention relates to a printing apparatus and a printing method.

2. Description of the Related Art

Printing apparatuses, such as inkjet printers, that are used in computer systems are provided with a printing apparatus main unit, an ink container that can be attached to and removed from the printing apparatus main unit and which contains ink that is supplied to the printing apparatus main unit, a print head provided with ink-ejecting sections, to which the ink container is mounted and which can be attached to and removed from the printing apparatus main unit, and a printing medium, such as roll paper, that can be attached to and removed from the printing apparatus main unit.

In recent years, a need has arisen for printed matter, which is printed by such printing apparatuses, to possess not only a simple quality for printing letters and/or line drawings, but also to possess higher image quality that is on par with silver halide photographs, leading to repeated improvements in the characteristics of the ink and the printing medium and in the arrangement of the ink-ejecting sections provided in the print head. Also, suitability relationships exist between the various types of inks, printing mediums, and print heads, so that it is preferable to print using components that are suitable with one another. For this reason, ink containers, printing media, and print heads come packaged as units provided with storage elements on which information on their characteristics and specifications, for example, is stored. The information is read from the storage elements of the units after they are installed, and if the units are suitable, then printing is possible, however, if they are not suitable, then the user is notified that the units are not suitable.

However, the heightened demand for high-quality images has led to improvements in the ink, the printed media, and the print heads, for example, in shorter times, and the task of most appropriately matching these components to one another has surpassed what can be handled simply by a program stored on the printing apparatus. For example, in a case where a print head with ink-ejecting sections at a narrow spacing is used in order to print at high-density with a small dot-to-dot spacing, it is necessary to not only use ink and printing media that blot little, but also, if for example a single line is to be printed, to change the print control program, including the print driver, for controlling printing so that adjacent dots are not printed sequentially but rather that the printing operation is divided into two operations: a first operation in which dots are printed with a spacing between them and a second operation in which printing to connect the dots is carried out. In this case, there was the problem that the user was forced to carry out the bothersome tasks of not only exchanging the ink unit, the printing medium unit, and the print head unit, but was also required to obtain and install print control programs suited for these units.

SUMMARY OF THE INVENTION

The present invention was arrived at in light of the foregoing problem, and it is an object thereof to achieve a printing apparatus and a printing method with which a print control program can be acquired by equipping an ink container, a printing medium, or a print head, for example.

In a main aspect of the present invention, a printing apparatus that can be connected to a communications line comprises:

an ink container for containing ink;

a printing medium that is capable of being printed with the ink in the ink container; and a print head for ejecting ink onto the printing medium; wherein, at least one of the ink container, the printing medium, and the print head can be attached to and removed from a main unit of the printing apparatus together with a memory, and an acquisition program for acquiring, via the communications line, a print control program for printing on the printing medium by causing ink to eject from the print head based on image data is stored on the memory.

In another main aspect of the present invention, a printing apparatus includes:

an ink container for containing ink;

a printing medium that is capable of being printed with the ink of the ink container; and a print head for ejecting ink onto the printing medium; wherein, at least one of the ink container, the printing medium, and the print head can be attached to and removed from a main unit of the printing apparatus together with a memory, and a print control program for printing on the printing medium by causing ink to eject from the print head based on image data that are input is stored on the memory.

Other features of the present invention will become clear through the accompanying drawings and the following description.

BRIEF DESCRIPTION OF THE DRAWINGS

FIG. 12 is a diagram showing a data table that specifies the type of the appropriate print control programs stored on a storage element 95 of a type A print head unit 60.

FIG. 13 is a diagram showing the appropriate print control programs stored on the storage element 95 of the type A print head unit 60.

FIG. 16 is a diagram showing a suitability data table specifying the type of the appropriate print control programs stored on the storage element 95 of a type B print head unit 60.

FIG. 17 is a diagram showing the appropriate print control programs that are stored on the storage element 95 of a type B print head unit 60.

FIG. 27 is a diagram showing a data table that specifies the type of the appropriate print control programs stored on a storage element 1095 of a type A print head unit 1060.

FIG. 28 is a diagram showing the appropriate print control programs stored on the storage element 1095 of the type A print head unit 1060.

FIG. 29 is a diagram showing a suitability data table specifying the type of the appropriate print control programs stored on the storage element 1095 of a type B print head unit 1060.

FIG. 30 is a diagram showing the appropriate print control programs that are stored on the storage element 1095 of a type B print head unit 1060.

DETAILED DESCRIPTION OF THE INVENTION

Figure 1:
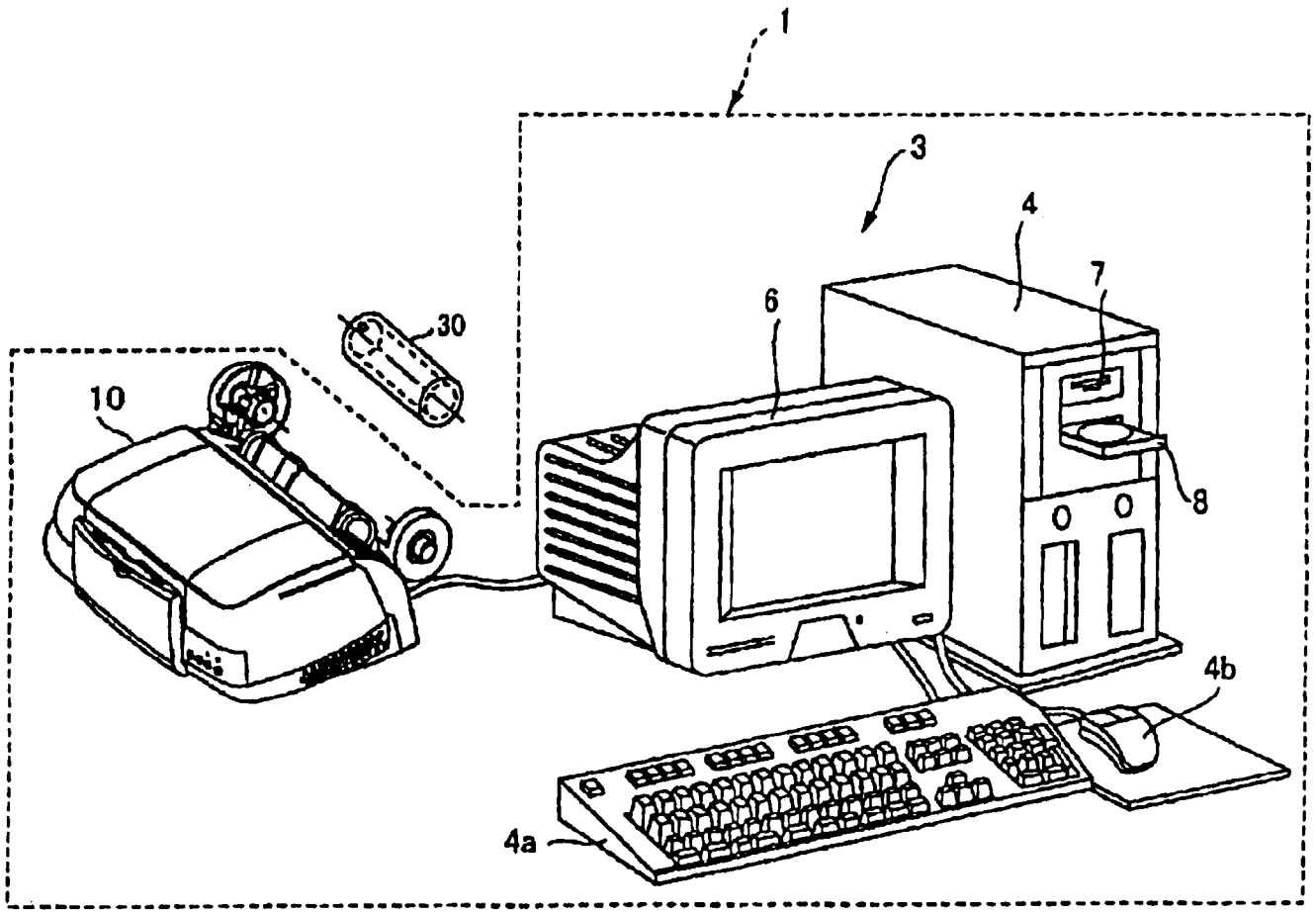
FIG. 1 is a diagram showing the overall configuration of a computer system according to a first embodiment.

At least the following matters will be made clear by the explanation in the present specification and the description of the accompanying drawings.

A printing apparatus that can be connected to a communications line, comprises an ink container for containing ink, a printing medium that is capable of being printed with the ink of the ink container, and a print head for ejecting ink to the printing medium, wherein at least one of the ink container, the printing medium, and the print head can be attached to and removed from a main unit of the printing apparatus together with a memory, and an acquisition program for acquiring, via the communications line, a print control program for printing on the printing medium by ejecting ink from the print head based on image data is stored on the memory.

According to such a printing apparatus, an acquisition program for acquiring, via the communications line, the print control program is stored on a memory provided in the detachable ink container, for example, and thus when a user exchanges the ink container, for example, the print control program is acquired via the electrical line.

It is preferable that the print control program is stored on a predetermined server connected to the communications line, and the acquisition program acquires the print control program from the server.

According to such a printing apparatus, the print control programs are stored on a server and are acquired by accessing that server from the printing apparatus, so that if it is desirable to provide a new program, that program can be provided to users simply by storing it on the server. Also, because the print control programs are stored on servers, which are connected to an electrical line, even if each unit is provided in various models, a large number of print control programs that corresponds to each of these models can be stored on the server.

It is preferable that the printing apparatus is connected to the communications line via a host computer, and that the acquisition program acquires the print control program via the host computer.

According to such a printing apparatus, it is possible to execute the acquisition program and to execute procedures for acquiring desired print control programs from servers with the host computer, so that print control programs can be acquired over the communications line without adding special functions to the printing apparatus.

It is also preferable that the print control program is a program that matches characteristics of the unit provided with the memory on which the acquisition program is stored.

According to such a printing apparatus, simply by exchanging the ink container (unit), the printing medium (unit), and/or the print head (unit), it is possible to execute a program that takes into account the characteristics of that unit, allowing an excellent image to be attained.

Furthermore, it is preferable that the print control program is a program for performing raster-row conversion processing.

According to such a printing apparatus, simply by exchanging a unit, it is possible to carry out printing using raster-row conversion programs generated according to different algorithms. Here, a raster-row conversion program refers to a program for correlating image data, which have been rasterized, with the number of nozzles to be used in the nozzle rows arranged in the sub-scanning direction, and then writing the image data to an intermediate buffer in order from the head of each raster data.

It is moreover preferable that the print control program stored in the storage means is a program for performing rasterization processing.

According to such a printing apparatus, simply by exchanging a unit, it is possible to carry out printing using rasterizing programs generated according to different algorithms Here, a rasterizing program refers to a program for converting, for each nozzle, the data to be printed into data that indicate the locations where dots should be formed by that nozzle.

Furthermore, it is preferable that if the memory is provided in or on the ink container, then the print control program may be a program that matches a tendency of the ink contained in the ink container to blot.

In this case, a print control program that takes into account the ink of the ink container that has been mounted can be used to print a good image in which blotting is inhibited.

It is also preferable that if the memory is provided in or on the printing medium, then the print control program is a program that matches a coefficient of friction or an ability to absorb ink of the printing medium.

If the print control program is a program that takes into account the coefficient of friction of the printing medium, then a print control program that takes into account the printing medium that has been installed can be used to accurately feed the medium to be printed, improving the accuracy at which the ink is ejected to the printing medium and allowing a high-quality image to be printed. If the print control program is a program that takes into account the ability of the printing medium to absorb ink, then it is possible to print a favorable image in which blotting is inhibited.

It is also preferable that if the memory is provided in or on the print head, then the print control program is a program that matches a number of ink-ejecting sections provided in the print head or a distance between the ink-ejecting sections.

According to such a printing apparatus, a favorable image can be printed using a print control program that takes into account the number of ink-ejecting section in the print head that is installed or the distance between the ink-ejecting sections.

It is also preferable that at least two of the ink container, the printing medium, and the print head are attachable/detachable together with memories provided in or on each of the two, unit information for identifying the unit in or on which the memory is provided is stored on each said memory, and by referring to a suitability data table indicating suitability between each of the units, one of the print control programs is specified based on the unit information.

According to such a printing apparatus, even if two or more units are installed, the print control programs that are suitable with each unit are specified and the most appropriate print control program that has been specified can be used to print an excellent image.

It should be noted that it is also possible to achieve an acquisition program for use in a printing apparatus that is connected to a communications line and that is configured so that at least one of an ink container for containing ink, a printing medium that is capable of being printed with the ink in the ink container, and a print head for ejecting ink to the printing medium is provided as a unit and can be attached to and removed from the printing apparatus together with a memory means, wherein the acquisition program is stored on the memory means and is for the printing apparatus to acquire, via the communications line, a print control program for printing on the printing medium by ejecting ink from the print head based on image data that have been input.

It should be noted that it is also possible to achieve a computer system program having a main computer unit, a display device that is connected to the main computer unit, and a printing apparatus that is connected to a communications line and configured so that at least one of an ink container for containing ink, a printing medium that is capable of being printed with the ink in the ink container, and a print head for ejecting ink to the printing medium is provided as a unit and can be attached to and removed from the printing apparatus together with a memory means, wherein an acquisition program for acquiring, via the communications line, a print control program for printing the printing medium by ejecting ink from the print head based on image data that have been input is stored on the memory means of the printing apparatus.

Furthermore, a printing method in which a printing apparatus that can be connected to a communications line is used comprises:

a step of attaching at least one of an ink container for containing ink, a printing medium that is capable of being printed with the ink of the ink container, and a print head for ejecting ink to the printing medium, to a main unit of the printing apparatus together with a memory, wherein an acquisition program for acquiring, via the communications line, a print control program for printing on the printing medium by ejecting ink from the print head based on image data is stored on the memory;

a step of the main unit of the printing apparatus reading out the acquisition program from the memory; and a step of obtaining a print control program through the acquisition program that is read out.

According to this printing method, for example, it is possible to achieve a printing method with which a new print control program can be provided via the communications line without recalling printing apparatuses that have already passed into the hands of users, allowing printing to be carried out through printing operations having different sequences than the program that was provided.

Further, a printing apparatus comprises:

an ink container for containing ink;

a printing medium that is capable of being printed with the ink of the ink container; and a print head for ejecting ink to the printing medium; wherein, at least one of the ink container, the printing medium, and the print head can be attached to and removed from a main unit of the printing apparatus together with a memory, and a print control program for printing on the printing medium by ejecting ink from the print head based on image data is stored on the memory.

According to such a printing apparatus, a print control program is stored in one of the ink container, the printing medium, and the print head, which are removable, and thus it is possible to obtain a print control program when a user exchanges any one of these. Also, it is possible to provide new print control programs and required programs to users via any of the ink container, the printing medium, and the print head, without recalling printing apparatuses that have already passed into the hands of the users. Thus, printing is possible through printing operations with different sequences without altering the printing apparatuses.

It is preferable that the print control program is a program that matches characteristics of the unit provided with the memory on which the program is stored.

According to such a printing apparatus, simply by exchanging the ink container, the printing medium, and the print head, it is possible to execute a program that takes into account the characteristics thereof, allowing an excellent image to be obtained.

Furthermore, it is also preferable that the print control program is a function that matches characteristics of the unit provided with the memory on which the program is stored, and that the function is referred to when a print control program stored on the printing apparatus is executed.

According to such a printing apparatus, a function, but not an entire print control program, is stored on the memory means provided in each unit, so that a smaller memory region is used, allowing a larger number of programs or other types of information, for example, to be stored.

Furthermore, it is preferable that the print control program is a program for performing raster-row conversion processing.

According to such a printing apparatus, simply by exchanging a unit, it is possible to carry out printing using raster-row conversion programs generated according to different algorithms. Here, a raster-row conversion program refers to a program for correlating image data, which have been rasterized, with the number of nozzles to be used in the nozzle rows arranged in the sub-scanning direction, and then writing the image data to an intermediate buffer in order from the head of each raster data.

It is moreover preferable that the print control program stored in the storage means is a program for performing rasterization processing.

According to such a printing apparatus, simply by exchanging a unit, it is possible to carry out printing using rasterizing programs generated according to different algorithms. Here, a rasterizing program refers to a program for converting, for each nozzle, the data to be printed into data that indicate the locations where dots should be formed by that nozzle.

It is also preferable that if the memory is provided in or on the ink container, then the print control program is a program that matches a tendency of the ink contained in the ink container to blot. In this case, a print control program that matches the ink in the ink container that has been mounted can be used to print a good image in which blotting is inhibited.

It is also preferable that if the memory is provided in or on the printing medium, then the print control program is a program that matches a coefficient of friction or an ability to absorb ink of the printing medium. If the print control program is a program that takes into account the coefficient of friction of the printing medium, then a print control program that takes into account the printing medium that has been equipped can be used to accurately feed the medium to be printed, improving the accuracy at which the ink is ejected to the printing medium and allowing a high-quality image to be printed. If the print control program is a program that takes into account the ability of the printing medium to absorb ink, then it is possible to print a favorable image in which blotting is inhibited.

It is also preferable that if the memory is provided in or on the print head, then the print control program is a program that matches the number of ink-ejecting sections provided in the print head or the distance between the ink-ejecting sections.

According to such a printing apparatus, a favorable image can be printed using a print control program that takes into account the number of ink-ejecting section in the print head that is installed or the distance between the ink-ejecting sections.

It is also preferable that at least two of the ink container, the printing medium, and the print head are attachable/removable together with memories provided in or on each of the two, unit information for identifying the unit in or on which the memory is provided is stored on each memory, and by referring to a suitability data table indicating suitability between each of the units, one of the print control programs is specified based on the unit information.

According to such a printing apparatus, even if two or more units are installed, the print control programs that are suitable with each unit are specified and the most appropriate print control program that has been specified can be used to print an excellent image.

It should be noted that it is also possible to achieve a print control program for use in a printing apparatus configured so that at least one of an ink container for containing ink, a printing medium that is capable of being printed with the ink of the ink container, and a print head for ejecting ink to the printing medium is provided as a unit and can be attached to and removed from the printing apparatus together with a memory means, wherein the print control program is stored on the memory means and is for the printing apparatus to achieve a function for causing ink to eject from the print head to print on the printing medium based on image data that have been input.

Furthermore, it is also possible to achieve a computer system program having a main computer unit, a display device that is connected to the main computer unit, and a printing apparatus that is configured so that at least one of an ink container for containing ink, a printing medium that is capable of being printed with the ink of the ink container, and a print head for ejecting ink to the printing medium is provided as a unit and can be attached to and removed from the printing apparatus together with a memory means, wherein a print control program for printing on the printing medium by ejecting ink from the print head based on image data that have been input is stored on the memory means of the printing apparatus.

A printing method comprises:

- a step of attaching at least one of an ink container for containing ink, a printing medium that is capable of being printed with the ink of the ink container, and a print head for ejecting ink to the printing medium to a main unit of the printing apparatus together with a memory, wherein a print control program for printing on the printing medium by ejecting ink from the print head based on image data is stored on the memory;
- a step of the main unit of the printing apparatus reading out the print control program from the memory; and
- a step of printing using the print control program that is read out.

According to this printing method, it is possible to achieve a printing method with which new print control programs that are stored on each unit can be provided without recalling the printing apparatuses that have already passed into the hands of users, allowing printing to be carried out through printing operations having different sequences than the provided program.

<<<First Embodiment>>>

Outline of the Configuration of a Computer System in which a Printing Apparatus is Employed First, an outline of the configuration of a computer system that uses the printing apparatus according to the first embodiment is described with reference to FIGS. 1 and 2. FIG. 1 schematically shows the configuration of a computer system according to the first embodiment, and FIG. 2 is a block diagram showing the configuration of the computer system illustrated in FIG. 1.

The computer system 1 shown in FIG. 1 is provided with a color printer CP serving as an example of a printing apparatus, and a host computer 3 that is connected to the color printer CP and that transmits and prints out image data. The host computer 3 is provided with a main computer unit 4, a CRT display 6 serving as a display means, a keyboard 4*a* and a mouse 4*b* serving as input devices, a flexible disk device 7, and a CD-ROM drive device 8.

Figure 2:
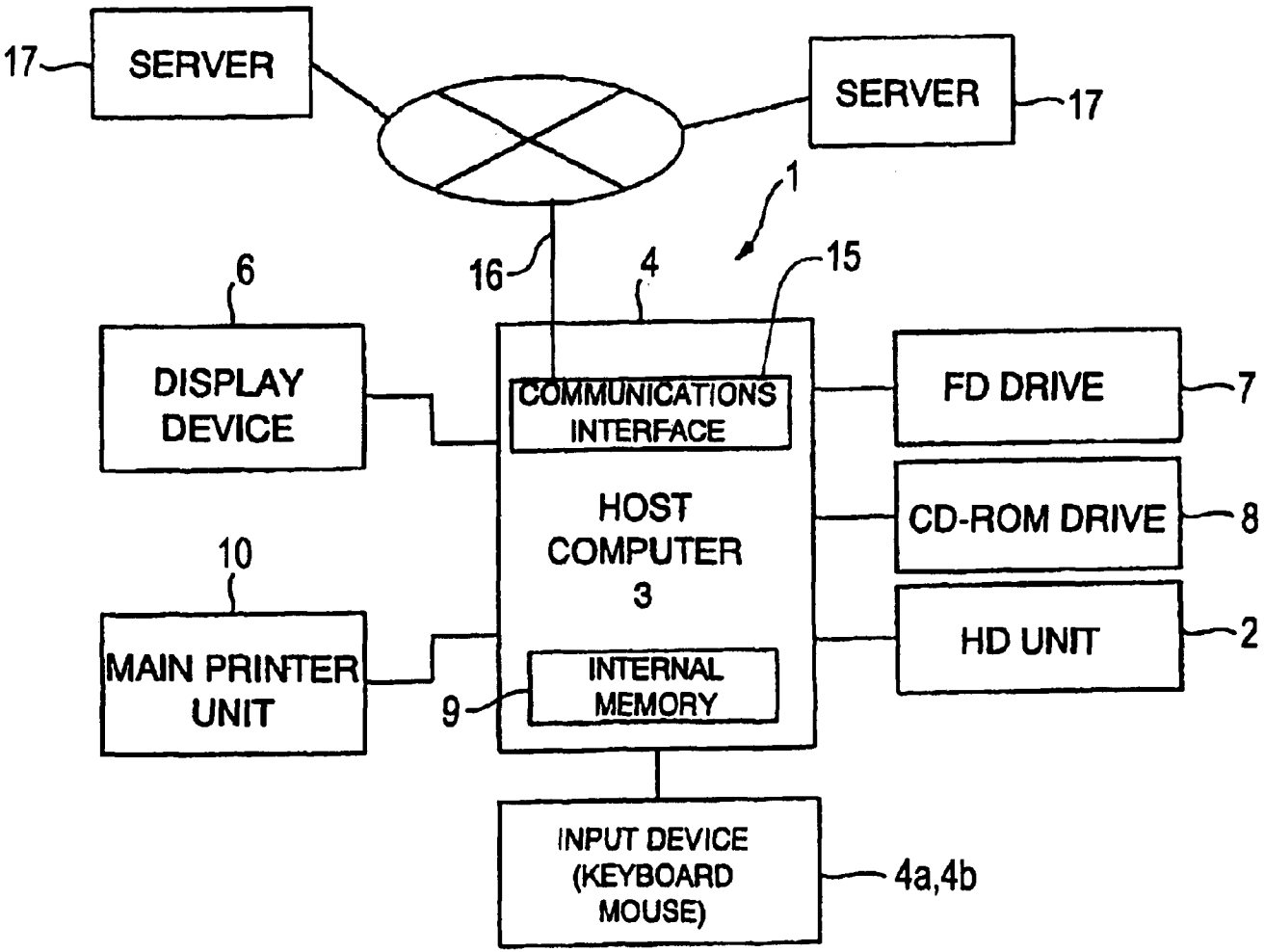
FIG. 2 is a block diagram illustrating the configuration of the computer system shown in FIG. 1.

FIG. 2 illustrates the configuration of this computer system in a block diagram. FIG. 2 shows that the housing in which the main computer unit 4 is accommodated is further provided with an internal memory 9, such as a RAM (random access memory), and an external memory, such as a hard-disk drive unit 2, and, moreover, includes a communications interface (hereinafter, referred to as "I/F") 15 via which the host computer 3 is connected to a communications line 16. The host computer 3 is provided with an application program for acquiring program files from servers 17 connected to a network, such as the Internet, via the communications line 16, which allows the host computer 3 to communicate with the large number of servers 17 that are connected to the communications line 16.

It should be noted that in the above description, the computer system 1 can have the minimum configuration that allows it to execute a function for printing to a printing medium and a function for acquiring files that are stored on the servers by connecting to the servers 17 via the communications line 16. Consequently, the CRT display 6 serving as a display means, the keyboard 4*a* and the mouse 4*b* serving as input devices, the flexible disk device 7, and the CD-ROM drive device 8, which were mentioned above, are not essential structural components.

Overview of the Configuration of the Printing Apparatus

Figure 3:
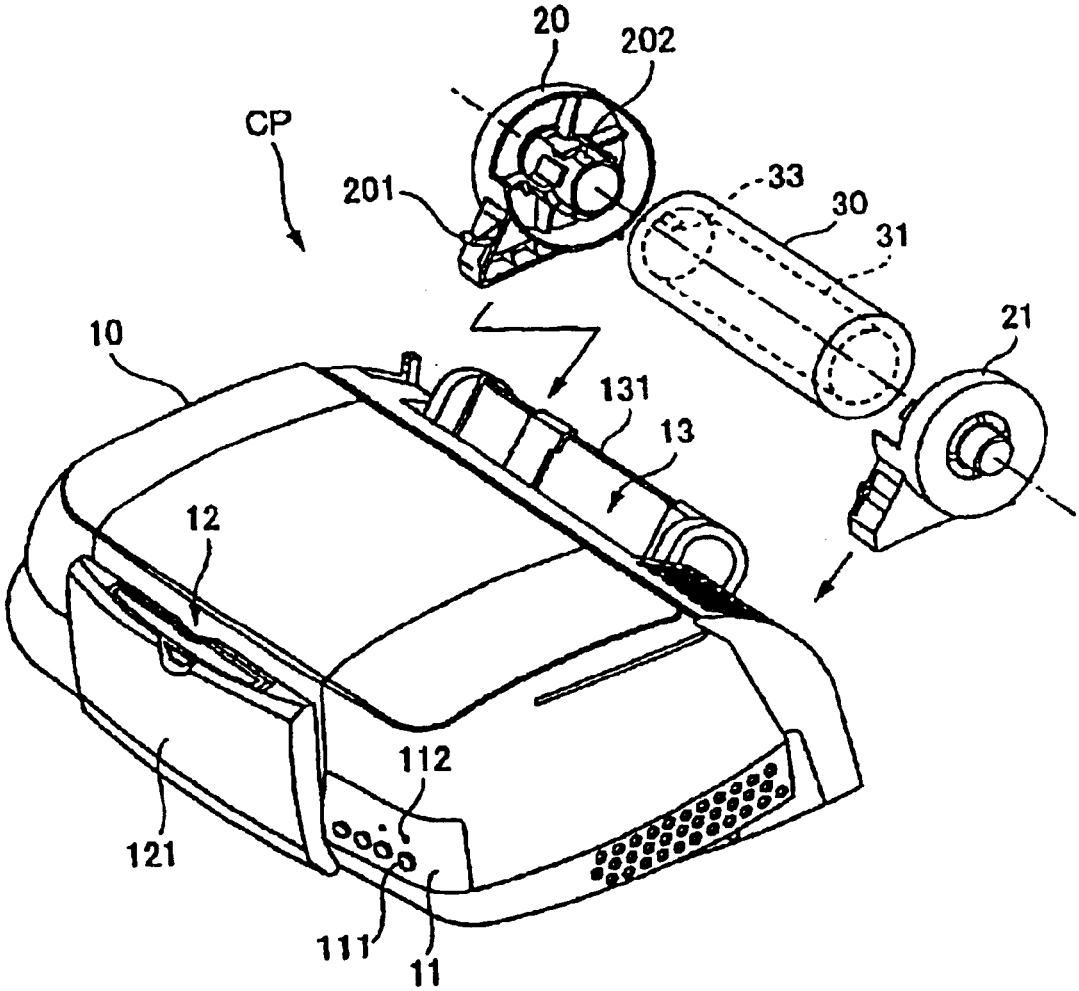
FIG. 3 is a diagram showing the overall configuration of the color printer CP according to the first embodiment.

With reference to FIG. 3, an overview of primarily the external structure of the printing apparatus is described. FIG. 3 shows the color printer CP as an example of a printing apparatus. It should be noted that the color printer CP has a main printer unit 10 serving as the printing apparatus main unit, and a roll paper unit 30 serving as a printing medium unit that is removably mounted to the main printer unit 10.

The color printer CP is capable of printing color images, and is an inkjet-type printer for forming images by ejecting four colors of color ink, such as cyan (C), magenta (M), yellow (Y), and black (K), onto a printing medium such as roll paper so as to form dots. It should be noted that in addition to these four colors it is also possible to use light cyan (LC), light magenta (LM), and dark yellow (DY) as the color ink.

As shown in FIG. 3, the color printer CP has a structure in which a printing medium, such as paper for printing, that is supplied from its rear side is discharged from its front side. The front side of the main printer unit 10 is provided with an operation panel 11 and a paper discharge section 12, and its rear side is provided with a paper supply section 13. The operation panel 11 is provided with a variety of operation buttons 111 and display lamps 112. The paper discharge section 12 is provided with a paper discharge tray 121 blocking the paper discharge opening when the printer is not in use. The paper supply section 13 is provided with a paper supply holder 131 for holding cut paper (not shown), and roll paper unit holders 20 and 21 for holding the roll paper unit 30.

Internal Configuration of the Color Printer CP

Figure 4:
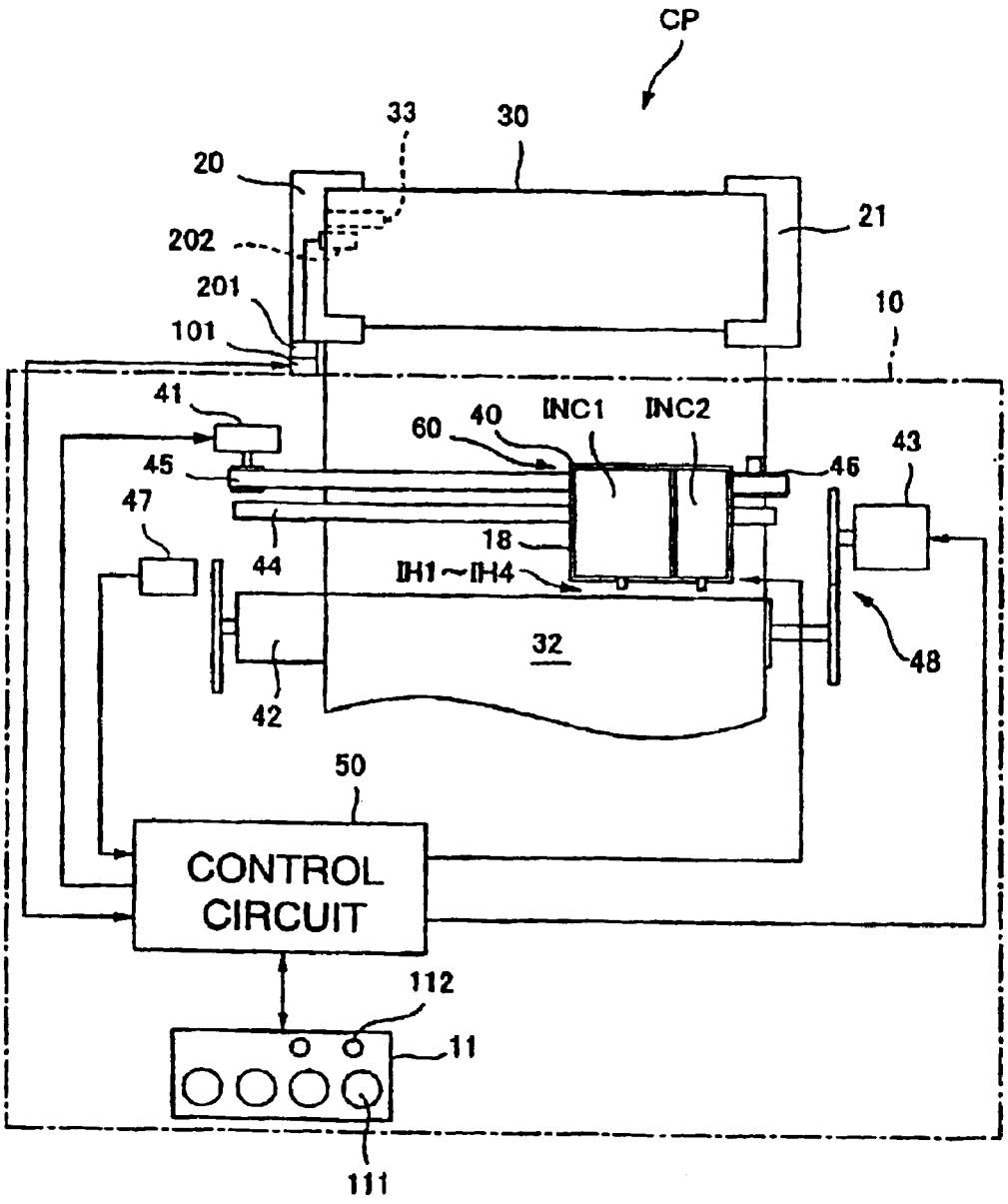
FIG. 4 is a diagram showing the internal configuration of the color printer CP according to the first embodiment.

Next, the internal configuration of the color printer CP is described with reference to FIG. 4. FIG. 4 shows the internal configuration of the color printer CP according to the first embodiment.

As shown in the drawing, the color printer CP has a mechanism for ejecting ink and forming dots by driving print heads IH1 to IH4 of the print head unit that is provided in a carriage 40 and that can be removably mounted, a mechanism for moving the carriage 40 back and forth in the axial direction of a platen 42 by a carriage motor 41, a mechanism for transporting the roll paper for printing 32 that is supplied from the roll paper unit 30 by a paper-feed motor 43, and a control circuit 50.

The mechanism for moving the carriage 40 back and forth in the axial direction of the platen 42 includes a slide shaft 44, which is provided parallel to the axis of the platen 42 and which slidably holds the carriage 40, and a pulley 46 with an endless drive belt 45 provided stretched between it and the carriage motor 41.

The mechanism for transporting the roll paper for printing 32 that is supplied from the roll paper unit 30 includes the platen 42, the paper-feed motor 43 for rotating the platen 42, a paper supply auxiliary roller, which is not shown, a gear mechanism 48 for transmitting the rotation of the paper-feed mechanism 43 to the platen 42 and the paper supply auxiliary roller, and an encoder 47 for detecting the rotation angle of the platen 42. Also, a contact 101 is provided on the main printer unit 10 in opposition to a contact 201 that is provided on the roll paper unit holder 20.

The control circuit 50 appropriately controls the movement of the paper-feed motor 43, the carriage motor 41, and the print heads IH1 to IH4 when a print command signal is input from the operation panel 11 of the printer or from the host computer 3 to which the printer is connected. The roll paper for printing 32 of the roll paper unit 30, which is held by the roll paper unit holders 20 and 21 of the color printer CP, is set so that it is sandwiched between the platen 42 and the paper supply A print head unit 60 and a cartridge mount section 18, which is provided as a single unit with the print head unit 60, are fastened to the carriage 40, and an ink cartridge INC1 and an ink cartridge INC2 serving as ink containers (hereinafter, may also be referred to as "ink container unit") are mounted to the cartridge mount section 18. Each ink cartridge INC! and INC2 is provided with a storage element 80 (see FIG. 5) for storing the ink type and the amount of ink remaining, for example, in addition to a program, which is described later. The ink cartridge INC2 holds black (K) ink, and the ink cartridge INC1 holds other inks, that is, it holds three colors of ink: cyan (C), magenta (M), and yellow (Y). As has been mentioned already, it may also contain light cyan (LC), light magenta (LM), and dark yellow (DY) ink.

Internal Structure of the Control Circuit 50

Figure 5:
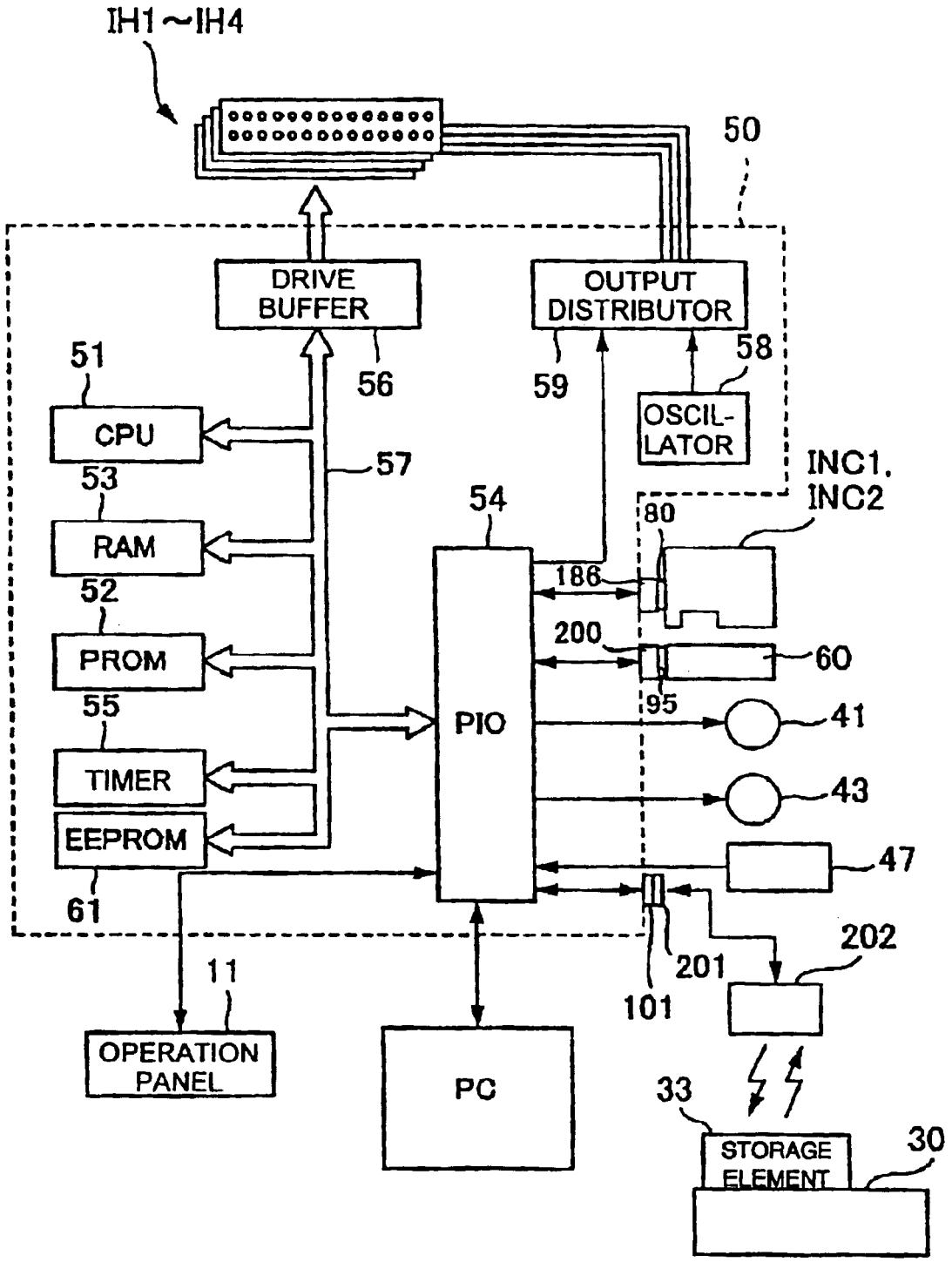
FIG. 5 is a block diagram showing the internal configuration of a control circuit 50 of the color printer CP according to the first embodiment.

Next, the internal configuration of the control circuit 50 of the color printer CP is described with reference to FIG. 5. FIG. 5 is a block diagram showing the internal configuration of the control circuit 50 of the color printer CP according to the first embodiment.

As shown in FIG. 5, a CPU 51, a PROM 52, a RAM 53, an EEPROM 61, a periphery device input/output section (PIO) 54 a timer 55, and a drive buffer 56, for example, are provided inside the control circuit 50.

Various types of information are stored on the EEPROM 61, and in the first embodiment in particular, a data table indicating print control programs suited for the combination of the roll paper 32, the ink, and the print heads IH1 to IH4 is stored and can be rewritten if necessary. Also, the EEPROM 61 is provided with a memory region in which print control programs have been appropriately written. The data table and the print control programs are described in detail later.

The PIO 54 is connected to a personal computer PC, a connecter 186 connecting it with the storage elements 80 of the ink cartridges INC1 and INC2, a connector 200 connecting it with a storage element 95 of the print head unit 60, the carriage motor 41, the paper-feed motor 43, the encoder 47, and a transmit/receive section 202 via the contacts 101 and 201. The drive buffer 56 is used as a buffer for supplying on/off signals for dot formation to the print heads IH1 to IH4. These are connected to one another by a bus 57 and can exchange data among one another.

The control circuit 50 is also provided with an oscillator 58 for outputting a drive waveform at a predetermined frequency, and an output distributor 59 for distributing the output from the oscillator 58 to the print heads IH1 to IH4 at a predetermined timing.

The control circuit 50 accesses the storage element 33 that is provided in a core material 31 of the roll paper unit 30, the storage elements 80 that are provided in the ink cartridges INC1 and INC2, and the storage element 95 that is provided in the print head unit 60 when, for example, the power is turned on, when the roll paper unit 30, the ink cartridges INC1 and INC2, and the print head unit 60 are exchanged, and when the power is turned off. The information that is read from the storage element 33 provided in the roll paper unit 30, the storage elements 80 that are provided in the ink cartridges INC1 and INC2, and the storage element 95 that is provided in the print heads IH1 to IH4, is stored in the RAM 53.

The control circuit 50 controls the printing operation in response to the information that is obtained from the storage element 33, the storage elements 80, and the storage element 95. The control circuit 50 outputs dot data to the drive buffer 56 at a predetermined timing while synchronizing with the movement of the paper-feed motor 43 and the carriage motor 42. The processes in which the information obtained from the storage elements 33, 80 and 95 is used are described in detail later.

Configuration of the Roll Paper Unit 30 and the Storage Element 33 Furnished Thereon===

The roll paper unit 30 is provided with the core material 31, the roll paper for printing 32 that is wound around the outer circumference of the core material 31, and the storage element 33, serving as a memory means, that is provided on the inner circumferential surface of the core material 31. It should be noted that on the storage element 33 are stored unit information on the characteristics, such as the water absorptivity, of the roll paper 32 and the coefficient of friction, for example, of the printed surface, a suitability data table indicating a plurality of print control programs that are suited for the combination of various types of print heads and various types of inks based on the unit information and if printing is carried out using the roll paper, and an acquisition program for acquiring various print control programs from predetermined servers 17 via the communications line 16.

The roll paper unit holders 20 and 21 for holding the roll paper 32 are arranged on either side of the rear side of the main printer unit 10, forming a pair. One of the roll paper unit holders 20 and 21 (in the case of the first embodiment, the roll paper unit holder 20) is provided with the electrical contact 201 between it and the main printer unit 10, and the transmit/receive section 202, which is electrically connected to the electrical contact 201 and which is for sending and receiving data to and from the storage element 33 of the roll paper unit 30. It should be noted that in order to show the contact 201 and the transmit/receive section 202 that are provided on the roll paper unit holder 20, the roll paper unit holders 20 and 21 are shown detached from the main printer unit 10 and the roll paper unit 30 in FIG. 3. Here, in addition to the acquisition program and the like, it is also possible to suitably store on the storage element 33 information on the roll paper, such as information on the paper type indicating whether it is normal paper or photo paper, for example, information on the paper thickness, information on the paper color, information on the paper width, information on the paper quality, and information on the manufacturing date.

Positional Relationship Between the Storage Element 33 and the Send/Receive Section 202

Figure 6:
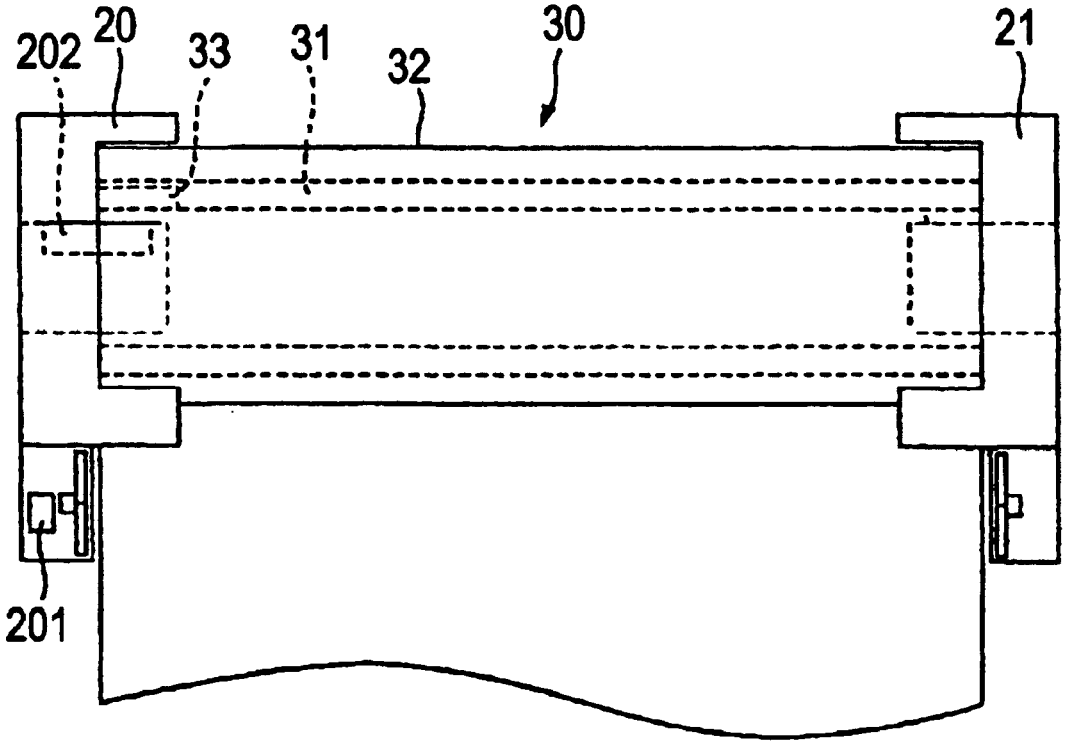
FIG. 6 is a diagram showing the positional relationship between a storage element 33 and a transmit/receive section 202 when a roll paper unit 30 is held by roll paper unit holders 20 and 21.
Figure 7:
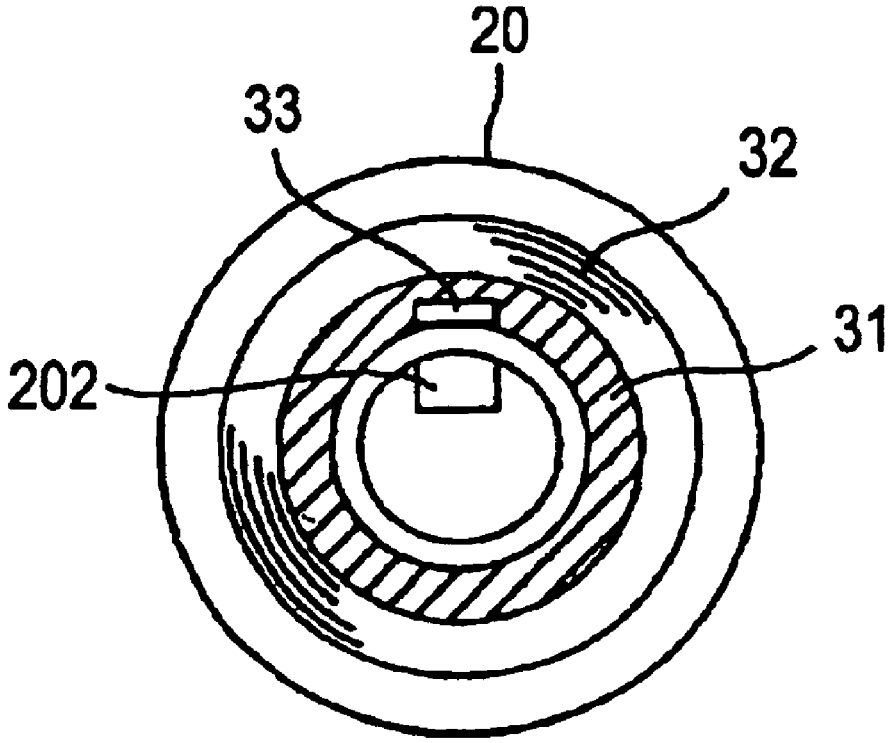
FIG. 7 is a lateral view of FIG. 6 seen from the side of the roll paper unit holder 20.

Next, the positional relationship between the storage element 33 of the roll paper unit 30 and the transmit/receive section 202 of the roll paper unit holder 20 is described with reference to FIGS. 6 and 7. FIG. 6 is a diagram showing the positional relationship between the storage element 33 and the transmit/receive section 202 in a state where the roll paper unit 30 is held by the roll paper unit holders 20 and 21. FIG. 7 is a lateral view of FIG. 6 seen from the side of the roll paper unit holder 20.

In this embodiment, a noncontact-type storage element is employed as the storage element 33, so that it is not necessary for the storage element 33 and the transmit/receive section 202 to be in contact with one another when data are sent and received. Consequently, as shown in FIGS. 6 and 7, there is a space between the transmit/receive section 202 and the storage element 33. Also, with a noncontact-type storage element, carrier waves that are transmitted from an outside transmit/receive circuit are rectified so as to generate the required power.

Each time the roll paper unit 30 makes one revolution the storage element 33 of the roll paper unit 30 is drawn closest to the transmit/receive section 202 of the roll paper unit holder 20. If a short range-type storage element with which transmission and reception are possible at a distance of about 2 mm is used as the storage element 33, then data can be sent and received when the storage element 33 and the transmit/receive section 202 are nearest to one another. If a midrange-type storage element with which transmission and reception are possible at a distance of about 10 mm is used, then data can be sent and received irrespective of the relative positions of the storage element 32 and the transmit/receive section 202. It should be noted that it is of course also possible to employ a contact-type storage element as the storage element 33. In this case, the roll paper unit holder 20 is provided with a contact in place of the transmit/receive section 202, and data are sent and received when the roll paper unit 30 is rotated and the contact on the side of the roll paper unit holder 20 comes into contact with the contact of the storage element.

Configuration of Ink Cartridges and the Cartridge Mount Section 18

The ink cartridges INC1 and INC2 serving as ink container units in the color printer CP share the same general structure. Accordingly, with the ink cartridge INC2 for black serving as an example, the structure of the ink cartridges and the structure for mounting these cartridges to the main printer unit 10 are described with reference to FIGS. 8 and 9.

Figure 8A:
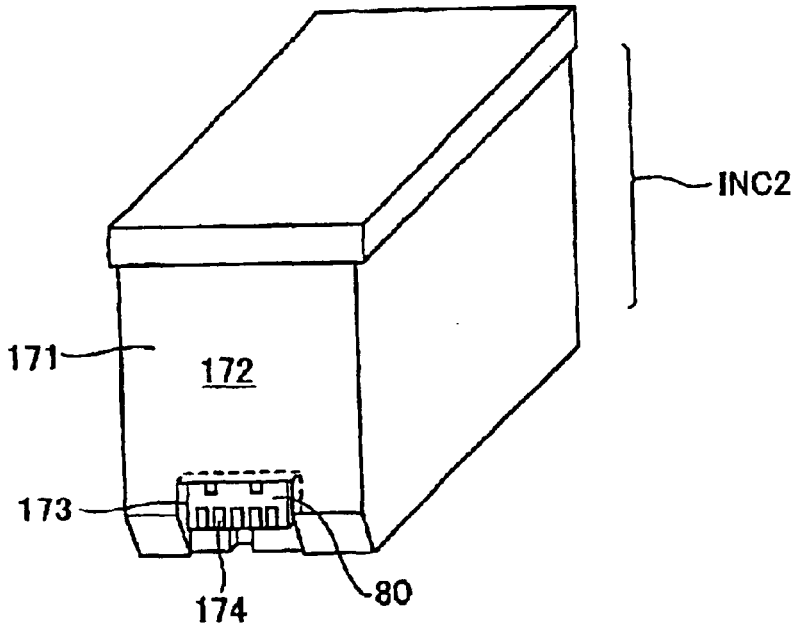
FIGS. 8A and 8B are perspective views showing the overall structure of ink cartridges and a cartridge mount section of a main printer unit 10.
Figure 8B:
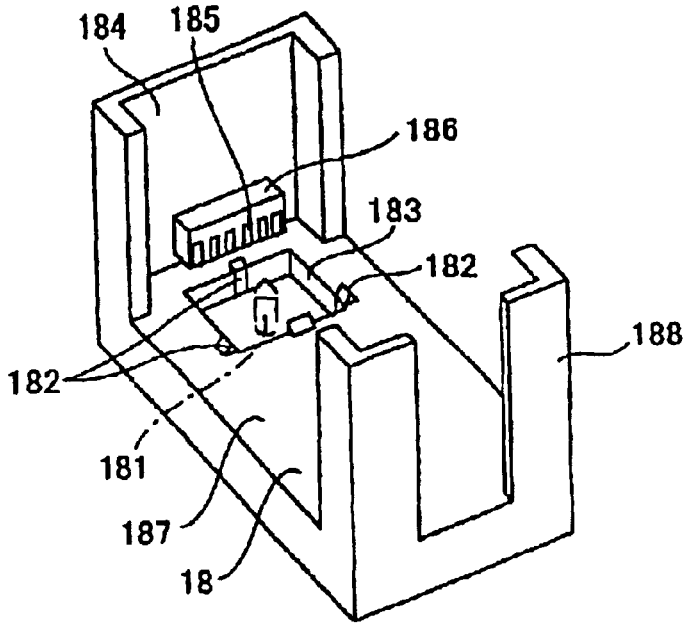
Figure 9:
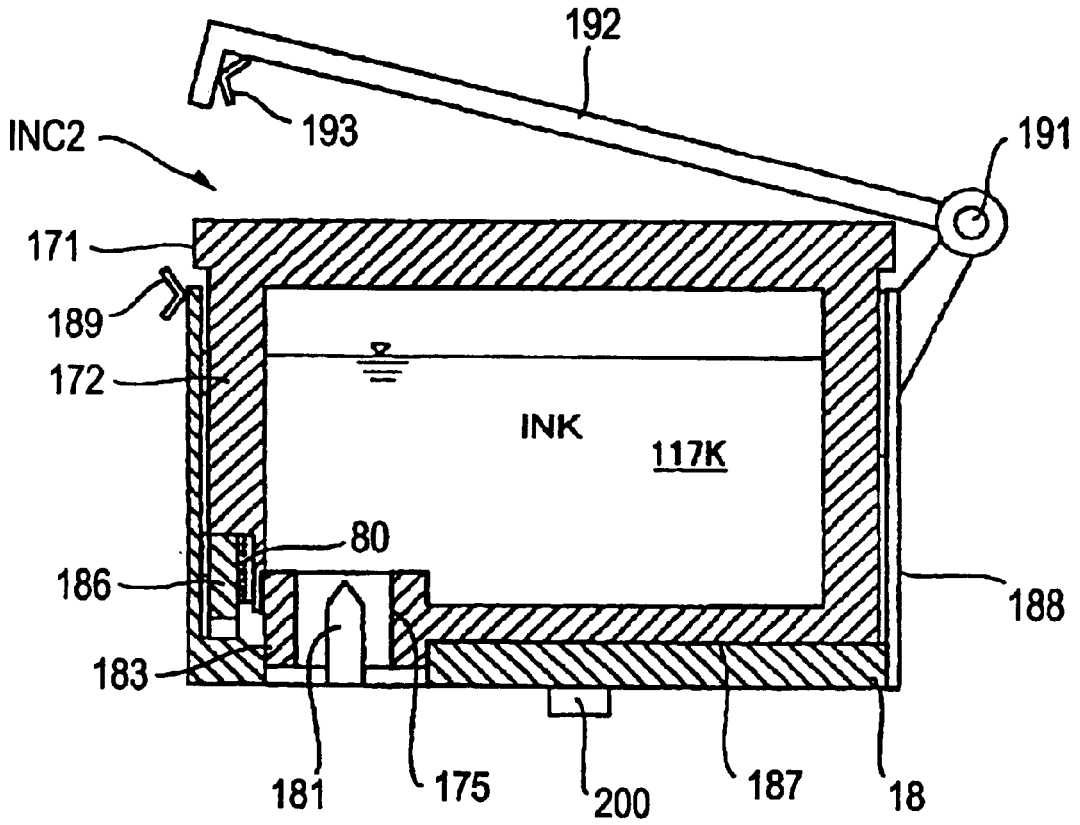
FIG. 9 is a cross-sectional view showing the internal structure of the ink cartridges, the internal structure of the cartridge mount section 18 on a carriage 40, and how the cartridge is mounted to the cartridge mount section 18.

FIG. 8 is a perspective view that schematically shows the structure of an ink cartridge and the cartridge mount section 18 of the main printer unit 10. FIG. 9 is a cross-sectional view showing the internal structure of the ink cartridge, the internal structure of the cartridge mount section 18 on the carriage 40, and how the cartridge is mounted to the cartridge mount section 18.

In FIG. 8, the ink cartridge INC2 is shown provided with a main cartridge unit 171 that is made of synthetic resin and that constitutes an ink container section 117K containing ink, and the storage element (memory means) 80 provided inside a side frame section 172 of the main cartridge unit 171. The storage element 80 sends and receives various types of data to and from the main printer unit 10 when the ink cartridge INC2 is mounted to the cartridge mount section 18 of the main printer unit 10. The storage element 80 is fitted into a recessed section 173 whose lower side with respect to the side frame section 172 of the ink cartridge INC2 is open, and thus only the plurality of connection terminals 174 are exposed.

On the other hand, the cartridge mount section 18 is provided with an aperture 183 in a bottom section 187 of the space in which the ink cartridge INC2 is mounted, and an ink introducing tube 181 of the print head IH1 that is mounted to the lower side of the cartridge mount section protrudes upward. An ink supply section 175 that is formed in the ink cartridge INC2 is inserted into the aperture 183, and cartridge guides 182 are formed in three locations in the inner wall of the aperture 183. A connector 186 is arranged in an inner wall 184 of the cartridge mount section 18. A plurality of electrodes 185 for electrically connecting to the plurality of connection terminals 174 of the storage element 80 when the ink cartridge INC2 is mounted to the cartridge mount section 18 are formed in the connector 186.

The procedure for fitting the ink cartridge INC2 to the cartridge mount section 18 is described next. First, the ink cartridge INC2 is arranged in the cartridge mount section 18. A fastening lever 192 is attached to a rear wall section 188 of the cartridge mount section 18 via a support shaft 191, and when the fastening lever 192 is pulled down so that it covers the ink cartridge INC2, the ink cartridge INC2 is forced downward, fitting the ink supply section 175 into the aperture 183. At this time, the ink introduction tube 181 of the print head unit 60 mounted to the ink cartridge mount section 18 is thrust into the ink supply section 175, allowing ink to be supplied. Moreover, when the fastening lever 192 is lowered, an interlocking section 193 formed in the tip of the fastening lever 192 engages an engaging member 189 that is formed in the cartridge mount section 18, fastening the ink cartridge INC2. In this state, the plurality of connection terminals 174 of the storage element 80 of the ink cartridge INC2 and the plurality of electrodes 185 of the cartridge mount section 18 are electrically connected to one another, allowing data to be sent and received between the main printer unit 10 and the storage element 80.

The structure of the ink cartridge INC2 is basically the same as the color ink cartridge INC1, and the ink cartridge INC1 will not be described. However, with the color ink cartridge INC1, three different color inks are filled into separate ink chambers, and it is necessary for these inks to be supplied to the print head along different routes. Consequently, with the color ink cartridge INC1, the number of ink supply sections 175 that are formed corresponds to the number of ink colors. It should be noted that although the ink cartridge INC1 accommodates three colors of ink, it is internally provided with only one storage element 80, and this single storage element 80 collectively stores information on the ink cartridge INC1 and information on each color of ink.

Configuration of the Storage Element 80 Provided in the Ink Cartridges

The storage elements 80 store unit information on the characteristics, such as the concentration, viscosity, and volatility, of the ink that is accommodated in that cartridge, a suitability data table indicating a plurality of print control programs that are suited for the combination of various types of print heads and various types of paper based on the unit information and if printing is carried out using the ink, and an acquisition program for acquiring various types of print control programs from predetermined servers 17 via the communications line 16. Also, in addition to the print control programs, as unit information it is also possible to appropriately store information on the type of ink, such as whether the ink is dye ink or pigment ink, information on ink characteristics such as the ink concentration, viscosity, and volatility, information on the amount remaining, and information on the manufacturing date of the ink, for example.

Configuration of the Print Head Unit 60

Figure 10:
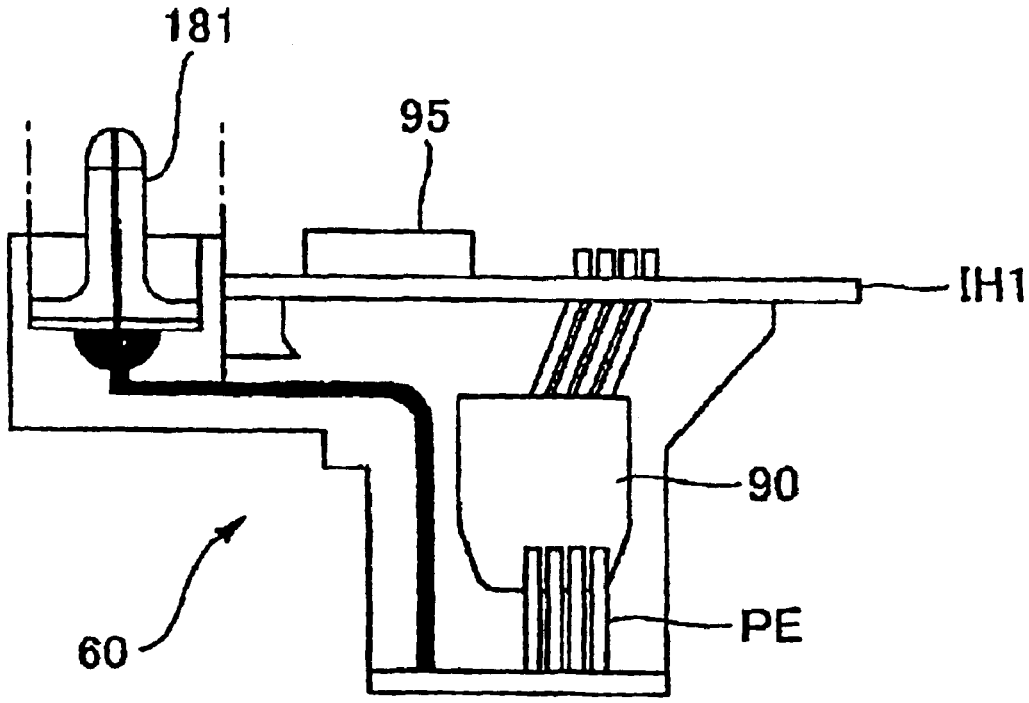
FIG. 10 is a cross-sectional view showing the overall structure of a print head unit 60.
Figure 11:
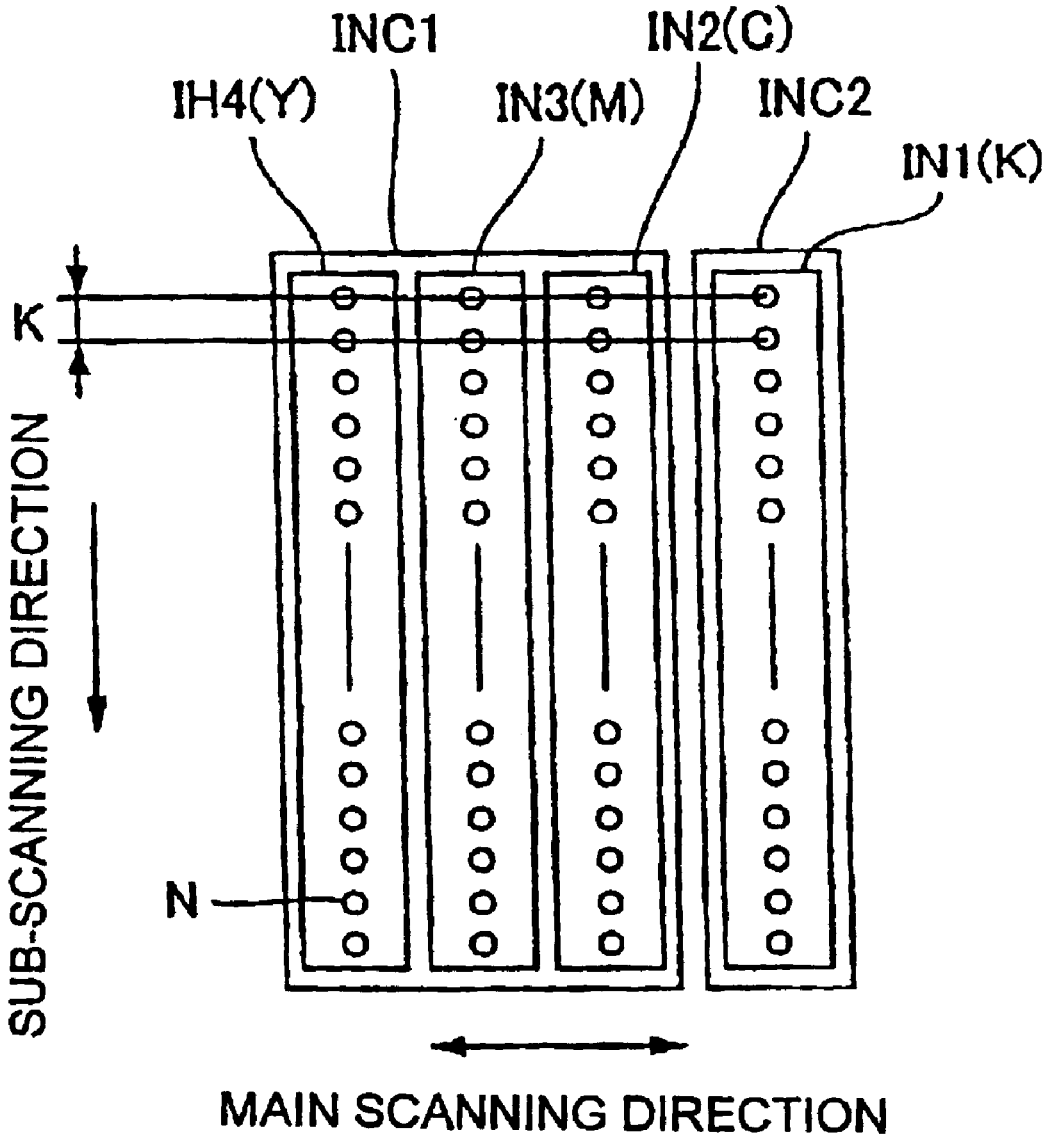
FIG. 11 is a diagram showing the arrangement of nozzles N in the first embodiment.

FIG. 10 schematically shows a cross section of the print head unit 60 provided below the ink cartridge mount section 18. FIG. 11 is a diagram showing the arrangement of the nozzles provided in the print heads IH1 to IH4. The print head unit 60 is configured as a single unit with the ink cartridge mount section 18, and is provided in the carriage 40 shown in FIG. 4.

The print head unit 60 is provided with a plurality of nozzles N, which are arranged in a row for each ink color and serve as ink-ejecting sections, piezo elements PE provided in each nozzle N, an actuator circuit 90 that drives the piezo elements PE in correspondence with head drive signals, and the storage element (memory means) 95 provided in an upper section of the print head unit 60.

When the print head unit 60 is mounted to the carriage 40 of the main printer unit 10, the storage element 95 is connected to the connector 200 provided in the carriage 40 and sends and receives various data with respect to the main printer unit 10 via a flexible cable connecting the carriage 40 and the control circuit 50.

As shown in FIG. 11, each print head IH1 to IH4 is provided for a color, and 96 nozzles are arranged in each print head in a line with a constant nozzle pitch (ejection section spacing) k between them in the sub-scanning direction, that is, in the direction in which paper is fed. The nozzle pitch k is set to an integer multiple of the resolution of the printed picture in the sub-scanning direction (dot pitch), and here is set to approximately 141 $\mu$m to correspond to a 180 dpi.

When the ink cartridges INC1 and INC2 are installed, the ink in the ink cartridges INC1 and INC2 is supplied from the ink introduction tube 181 to the print head unit 60 through capillary action. On the other hand, a common drive signal that is adopted for all the nozzles N is generated in the print head drive circuit within the control circuit 50 and is supplied to the print heads IH1 to IH4. The actuator 90, in accordance with a print signal PS that is supplied from a personal computer PC, latches the data for each nozzle N indicating whether that nozzle is on (ejecting ink) or off (not ejecting ink), and for only the on nozzles N, transmits the common drive signal that is applied from the print head drive circuit to the corresponding piezo element PE arranged in contact with the ink route. Voltage is applied to the piezo element PE by the common drive signal, and as well known in the art, the crystalline structure of the piezo element is deformed and quickly expands, increasing the volume of the ink route and allowing an amount of ink corresponding to that increase to be ejected from the nozzle N.

The storage element 95 stores unit information on the density, number, and diameter, for example, of the nozzles provided in the print heads IH1 to IH4, a suitability data table indicating a plurality of print control programs that are suited for the combination of various types of inks and various types of paper based on the unit information and if printing is carried out using the print heads IH1 to IH4, and an acquisition program for acquiring various print control programs from predetermined servers 17 via the communications line 16.

Acquisition Program

The acquisition program that is stored on the storage element 33 of the roll paper unit 30, the storage elements 80 of the ink cartridges INC1 and INC2, and the storage element 95 of the print head unit 60 is a program for acquiring predetermined printing processing programs over the communications line 16 onto the host computer 3 to which the color printer CP is connected.

The acquisition program has a function for using the control circuit 50 of the color printer CP to send a command signal for executing a command for transferring files, such as an FTP (file transfer protocol) command, to the host computer 3, and after the host computer 3 has performed the FTP command and acquired a predetermined print control program, for making the host computer 3 transmit the print control program that has been acquired to the color printer CP. When the command execution signal is transmitted to the host computer 3, the server address and the data file name for the print control program to be acquired are also transmitted.

Then, the FTP command is executed by the host computer 3 in accordance with the FTP command execution signal that is sent from the color printer CP, and the print control program that takes into account the server address and the data file name that are received is acquired via the communications line 16.

Print Control Program

The print control program is a program for printing to a printing medium by ejecting ink from the print heads IH1 to IH4 based on the image data. The print control program is for example a program for suitably ejecting ink from predetermined nozzles N of the print head unit 60 based on image data created by a printer driver that has been installed in the host computer 3, and includes a rasterizing program and a raster-row conversion program. The print control program can also include an image progressing program for halftone processing, color conversion processing, or multithresholding, for example, which are well known in the art, and it may also include a printer driver if necessary.

The image data that are input are developed into a matrix consisting of the number of dots in the main-scanning direction and the number of dots in the sub-scanning direction to match the degree of resolution that has been designated by the user, and are also color separated by ink color and stored in a buffer. Based on the data (referred to as "raster data") for each line in the main-scanning direction of the image data, ink is ejected from predetermined nozzles N of the print heads IH1 to IH4, which are scanned in the main-scanning direction, to form the image. Consequently, 96 main-scan lines can be printed by scanning once with the print heads IH1 to IH4 because the 96 nozzles are arranged in a line in the sub-scanning direction on the print heads IH1 to IH4.

As mentioned above, a rasterizing program refers to a program that executes a process for converting, for each nozzle, data to be printed into data indicating the locations where dots are to be formed by that nozzle. With a rasterizing program, for example, if an image is printed both forward and backward in the main-scanning direction, then the arrangement of the image data is reversed to correspond to the main-scanning direction. Also, if each raster is formed using two nozzles, that is, if so-called overlap recording is performed, then the image data are rearranged so that the data of odd-numbered pixels are supplied to one nozzle and the data of even-numbered pixels are supplied to the other nozzle. At this time, mask data are inserted at even-numbered pixels for the nozzles that form only odd-numbered pixels.

The rasterizing programs of the present embodiment include a program for rearranging raster data so as to allow the image data to be printed by the print heads IH1 to IH4 if the dot pitch corresponding to the resolution of the image data stored in the buffer is different than the nozzle pitch k of the print heads IH1 to IH4 that are equipped, and a program for controlling the location of the dots that are printed in each scan if the raster data for a single line are not printed by scanning once with the print heads IH1 to IH4 but rather are printed by scanning them a plurality of times.

More specifically, if the user sets the image resolution to 360 dpi (dot pitch of approximately 70.6 $\mu$m) and image data corresponding to this are input, then when the raster data of the first line of the image data are printed by the first nozzle of a print head with a nozzle pitch of 141 $\mu$m and the raster data of the second line are printed by the second nozzle of the same print head, the length in the sub-scanning direction is doubled and the image resolution becomes 180 dpi, making it impossible to print the requested image. For this reason, a program for rearranging the raster data rearranges the raster data so that, for example, if printing is performed using print heads having four nozzles in the sub-scanning direction, then the raster data of the first, third, fifth, and seventh lines are correlated to the nozzle row from the top in that order and are printed when the print heads are scanned for the first time. Then, after the paper has been moved approximately 70.6 $\mu$m in the sub-scanning direction by the paper-feed motor, the raster data of the second, fourth, sixth, and eighth lines are correlated to the nozzle row from the top in that order and are printed when the print heads IH1 to IH4 are scanned for the second time. A program for controlling the locations of the dots is adopted if, for example, based on the characteristics of the ink and the paper, there is a risk that blotting will occur and lower the image quality when ink is ejected to a location near dots that have been ejected but have not dried. In other words, such a program is for rearranging the raster data into the order in which they are to be printed in each scan of the print heads IH1 to IH4 if a single line of raster data are printed spaced at the dot spacing in the main-scanning direction when scanning the print heads IH1 to IH4 for the first time, and then the space between the dots is printed as the print heads IH1 to IH4 are repeatedly scanned without the paper being fed.

The raster-row conversion program is a program for associating the image data that have been rasterized as mentioned above with the number of nozzles that are used in the nozzle rows arranged in the sub-scanning direction, and then writing them to an intermediate buffer in order from the start of the raster data. That is, it is a program for converting raster (scan line) data into row data. Here, one example of a raster-row conversion program stored on the storage elements is a program for raster-row conversion of the image data based on the print mode and the specification of the print heads that are installed when one row of pixel data are printed if, for example, the number of pixel data number in one nozzle row of the print heads is different than the number of nozzles in one row of the nozzle row of the print heads. At this time, of the rasterizing programs, it is also possible for the raster-row conversion program to include a portion of the program relating to the number of nozzles, for example.

The print control programs, including the rasterizing programs and the raster-row conversion programs, are programs that correspond to the characteristics of the ink container, the printing medium, and the print heads, for example.

Consequently, if the storage element is provided in an ink container, then it is preferable that print control program is a program that takes into account to the tendency of the ink accommodated in the ink container to blot.

Also, if the storage element is provided in the printing medium, then it is preferable that the print control program is a program that takes into account the coefficient of friction of the printing medium or its ability to absorb ink.

Also, if the storage element is provided in the print heads, then the print control program is preferably a program that takes into account the number of ink-ejecting sections provided in the print heads or the distance between the ink-ejecting sections.

It should be noted that the print control program can also be a program that takes into account the tendency of the ink accommodated in the ink container to blot, the coefficient of friction of the printing medium or its ability to absorb ink, or the number of ink-ejecting sections provided in the print heads or the distance between the ink-ejecting sections, regardless of where the storage elements are provided.

The programs that are suitable for the rasterizing program and the raster-row conversion program differ depending on the nozzle pitch of the print heads and the characteristics of the ink and the paper, for example, or depending on whether the request of the user prioritizes printing speed or image quality. Consequently, the program that is set is appropriate for the print heads, the ink, the paper, and the combination of the three.

Combination of Print Heads, Ink, and Paper, and Setting the Print Control Program FIG. 12 is a diagram showing an example of a data table stored on the PROM 52 in advance. FIG. 12 shows a type selection data table for selecting from three print control programs (type P1, type P2, type P3) suited for the combination of three types of paper (paper α, paper β, paper γ), three types of ink (ink a, ink b, ink c), and type A print heads IH1 to IH4 mounted to the main printer unit 10. For example, the type P1 print control program, which is suited for the print heads IH1 to IH4 that have been equipped, is selected if ink cartridges INC1 and INC2 accommodating the ink a are installed and a roll paper unit 30 with the paper α is set.

FIG. 13 is a program specification data table indicating the combination of the rasterizing programs and the raster-row conversion programs that correspond to the type of print control program selected from the type selection table. When type P1 is selected as in the above example, then the rasterizing program (1) and the raster-row conversion program (1) are specified according to the program specification data table, and these programs are employed to carry out printing.

For example, blotting is more apt to occur when ink a is used to print to paper α, whereas blotting is less likely to occur when ink c is used to print to paper γ. In this case, the rasterizing program (1) that is specified by type P1 is a program for printing one line of raster data every three dots, such as printing one line of raster data while the print heads are scanned four times, and the raster-row conversion program (1) is a program for correlating the raster data in order from the first nozzle so as to match the number of nozzles in the nozzle row. On the other hand, the rasterizing program (3) that is specified by type P3 is for example a program for sequentially printing adjacent dots, and the raster-row conversion program (1) is the same program as described above because the print heads are the same.

When the control circuit 50 accesses the storage elements 33, 80, and 95 provided in the print head unit 60, the ink cartridges INC1 and INC2, and the roll paper unit 30, respectively, the data tables that are stored on the storage elements 33, 80, and 95 that are accessed are read out, and if necessary, the data table in the PROM 52 is rewritten.

If print control programs corresponding to the data table are not stored on the PROM 52, then an acquisition program stored on the storage elements 33, 80, and 95 of the print head unit 60, the ink cartridges INC1 and INC2, and the roll paper unit 30, respectively, is executed and the print control programs acquired via the communications line 16 are stored on the PROM 52.

Printing Operation Using the Color Printer CP

Figure 14:
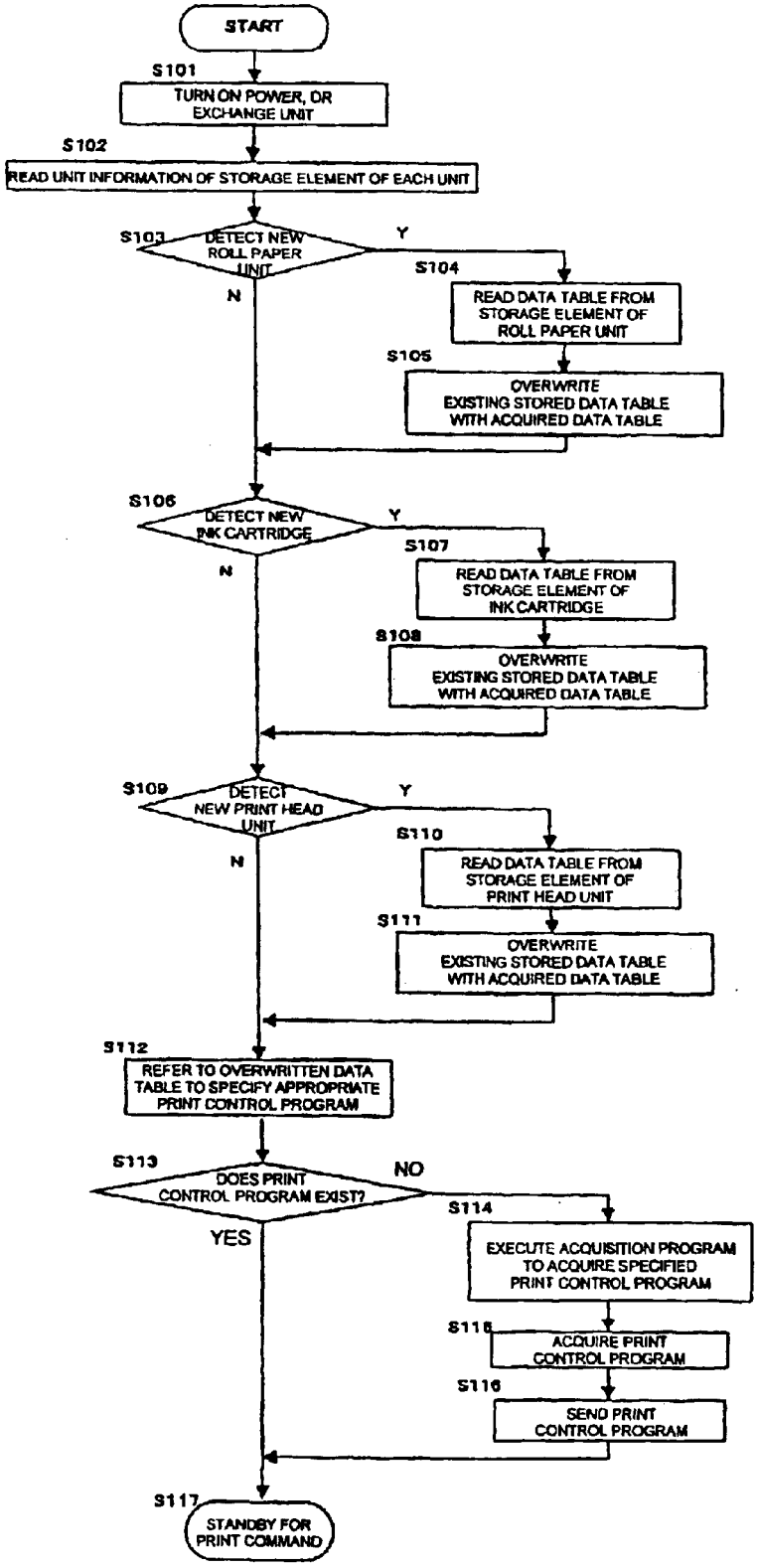
FIG. 14 is a flowchart illustrating the operation of the acquisition programs stored on the storage elements.
Figure 15:
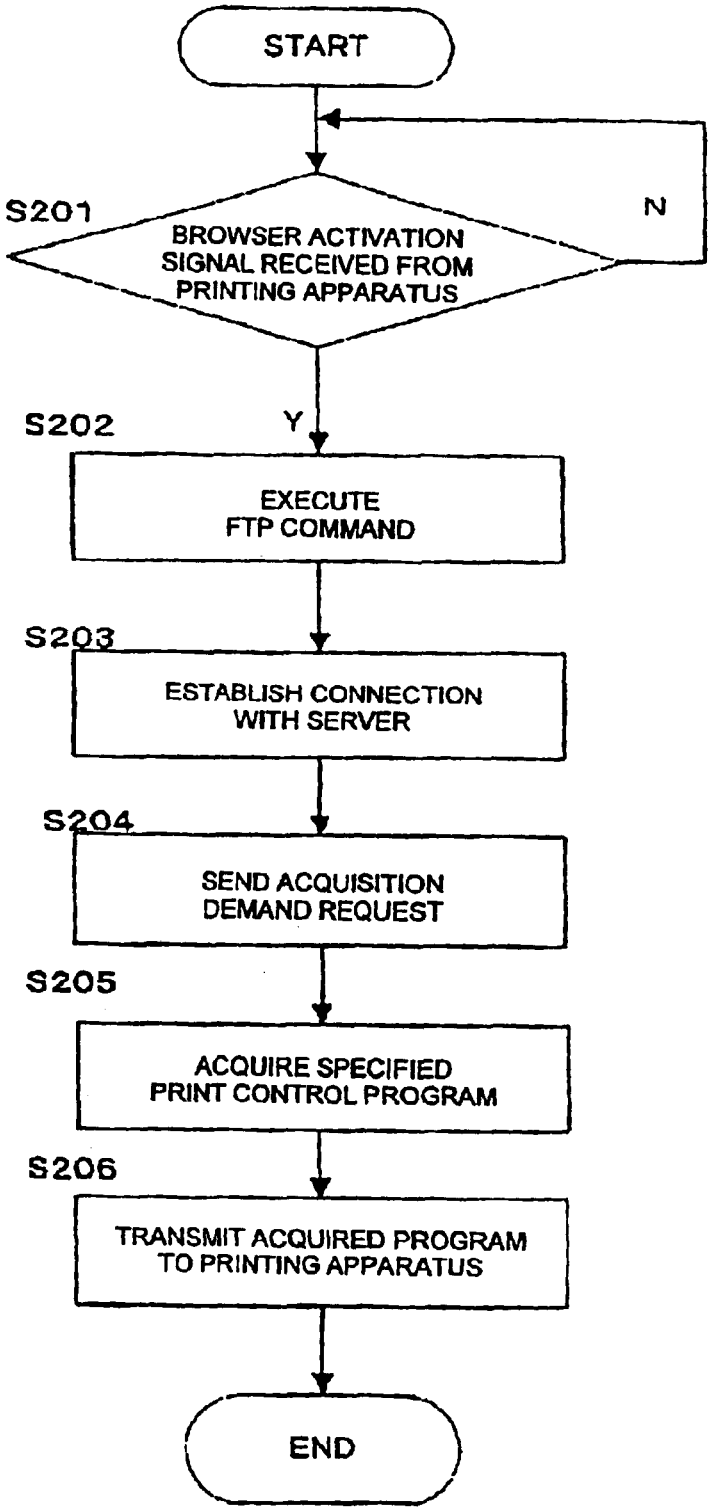
FIG. 15 is a flowchart illustrating the program acquisition process that is executed by the control means of a host computer 3.

Next, the operation for acquiring print control programs through a computer system that includes the color printer CP and the host computer according to the present embodiment is described with reference to FIGS. 14 and 15. FIG. 14 is a flowchart showing the operation of the acquisition program stored on the storage elements, and FIG. 15 is a flowchart showing the program acquisition process that is executed by a control means of the host computer 3.

After the power is turned on or after the user performs the task of exchanging the roll paper unit 30, the ink cartridges INC1 and INC2, and/or the print head unit 60 (S101), the color printer CP reads out the unit information that is stored on the storage element 33 provided in the roll paper unit 30, the storage elements 80 that are provided in the ink cartridges INC1 and INC2, and the storage element 95 that is provided in the print head unit 60 (S102). At this time, if all the unit information in the storage elements 33, 80, and 95 coincides with the information that is already stored on the EEPROM 61, then the color printer CP enters a standby state in which it waits for a printing command from an outside PC, for example, after predetermined initializing operations are performed (S117).

On the other hand, if the unit information in any of the storage elements 33, 80, and 95 includes information different that the information that is already stored on the EEPROM 61 (S103, S106, S109), then the unit information and a suitability data table indicating a plurality of programs that are suited for the combination of the units if the units are used to carry out printing are read from the storage element on which this information is stored (S104, S107, S110), and the data table that is already stored is overwritten with the suitability data table that is read out (S105, S108, S111). Then, referencing the data table that has been newly written, the print control program that is suited for the combination of roll paper unit 30, the ink cartridges INC1 to INC4, and the print head unit 60 that are installed is specified (S112). It should be noted that unit information for identifying each unit is used at the time of this specifying. Next, if the print control program that has been specified is not stored on the memory of the main printer unit 10 (S113), then the acquisition program that is stored on the storage element of the unit that has been newly installed is executed by the control circuit 50 (S114).

When the acquisition program is executed, the control circuit 50 transmits to the host computer 3 an execution signal of a command for performing file transfer, such as an FTP (file transfer protocol) command, as well as the address of the server on which the specified print control program is stored and the file name.

The host computer 3 receives the execution signal of the FTP command (S201), runs the FTP command (S202), and establishes a connection between it and the server 17 of the above-mentioned address (S203). Then, an acquisition demand request for acquiring the file name and the program file of the program that has been specified is transmitted to the server 17 from the host computer 3 (S204). The server 17 that receives the acquisition demand request responds by transmitting the program of the specified file name to the host computer 3 (S205).

The host computer 3 that has received the above response next receives the program file (S115), which it then transmits to the color printer CP (S116). The color printer CP stores the program that is transmitted from the host computer in the EEPROM 61, and after performing predetermined initialization operations, enters a state of standby in which it waits for a print command from, for example, an outside PC (S117).

In the following illustrative example, the user has exchanged the print head unit of the type mentioned above, which has a nozzle pitch of approximately 141 $\mu$m (corresponds to 180 dpi), with a type B print head unit, which has a nozzle pitch of approximately 70.6 $\mu$m (corresponds to 360 dpi). When the user has finished the task of exchanging the print head units and, for example, closes the outside cover, a signal indicating that the exchange of the print head units has finished is received by the control circuit 50 (S101), which then reads the unit information from the storage element 95 of the print head unit (S102). When it is consequently recognized that a new print head unit (type B) has been installed (S109), a type selection data table, which is a suitability data table indicating a plurality of print control programs that are suitable with the combination of various types of inks and various types of paper if printing is performed using the type B print head unit, and a program specification data table are obtained from the storage element 95 of the print head unit (S110), and the data tables that are already stored are overwritten (S111). FIGS. 16 and 17 show examples of suitability data tables that are stored on a type B print head unit.

In a case where the roll paper of the roll paper unit 30 that is fitted into the color printer CP is the paper $\alpha$ or the paper $\beta$ and the ink of the ink cartridges INC1 to INC4 is the ink a or the ink b, then printing is possible using one of the already stored print control programs P1 to P3, and thus the color printer CP is in a state of standby in which it waits for a print command (S117).

On the other hand, in a case where the roll paper of the roll paper unit 30 that is fitted into the color printer CP is the paper $\gamma$ or the ink of the ink cartridges INC1 to INC4 is the ink c, then a new print control program P4 is appropriate, as shown in the suitability data table of FIG. 16. The print control program P4 includes the rasterizing program (4) and the raster-row conversion program (1), and the rasterizing program (4), which was not stored when the type A print head unit 60 was equipped, becomes necessary (S113). Thus, the control circuit 50 accesses the storage element 95 of the newly installed print head unit and reads out the address of the server 17 on which the specified print control program is stored and the file name from the storage element 95, and with the method described above, acquires the rasterizing program (4) via the communications line and stores it in the EEPROM 61, so that the color printer CP enters the standby state (S117). Here, the rasterizing program (4) is a raster-row conversion program for a case in which the nozzle pitch 70.6 $\mu$m of the type b print head unit matches the dot spacing of the 360 dpi image resolution specified by the user, and is a program for converting data so that raster data are sequentially correlated to the nozzles from the top of the nozzle row, so that raster data of the first line, which corresponds to the top of an image, are printed by the first nozzle of the print head and the raster data of the second line are printed by the second nozzle of the same print head. The example shown here was one in which the print heads were exchanged, however, print control programs are specified and obtained in the same manner if the ink cartridge, the roll paper unit, or a combination of these is exchanged.

With the printing apparatus of the present embodiment, even if any of the roll paper unit 30, the ink cartridges INC1 and INC2, and the print head unit 60 are exchanged and a print control program that is suited for these does not exist in the color printer CP, a superior image can be printed because the most suitable print control program is specified based on the unit information and the suitability data tables that are stored on the storage elements 33, 80, and 95 of the roll paper unit 30, the ink cartridges INC1 and INC2, and the print head unit 60, respectively, and the specified print control program can be acquired via the communication lines 16 by an acquisition program stored on the storage elements 33, 80, and 95.

Also, because the print control programs are stored on the servers 17 and the host computer 3 can access the servers 17 and acquire the programs, a manufacturer or the like who wishes to provide a new program can provide that program to users simply by storing it on a server 17. In other words, it is not necessary to individually distribute the program to each user and arduous procedures can be significantly reduced, improving the convenience for both manufacturer and user. Moreover, the print control programs are stored on the servers 17, which are connected to the communications line 16, so that even if each unit is provided in a variety of different models, a large number of print control programs corresponding to all the different models can be stored on the servers 17.

In the storage element 33 of the roll paper unit 30, it is also possible to store correction information for optimizing the feed amount of the roll paper 32 based on the coefficient of friction of the roll paper 32, a suitability data table for the roll paper unit and the printer in which it is installed, and an acquisition program for acquiring printer drivers having different feed amounts for the roll paper 32 to serve as the print control programs that are selected based on the suitability data table. By doing this, the printer driver with which the roll paper is most suitably fed is read out to the main printer unit 10 when the roll paper is fitted, and by feeding the paper to correspond to the roll paper that has been fitted, ink is ejected at the correct locations, allowing a higher quality image to be printed.

In this embodiment, an example was shown in which only a rasterizing program that has become necessary due to the installation of a new print head unit is obtained via the communications line 16, however, it is also possible to read all print control programs that are required for printing from the servers 17. Additionally, it is not absolutely necessary that the print control programs are read to the main printing unit 10, and they may also be stored on a memory of the host computer 3.

Moreover, when all of the print control programs that are required for printing are stored on the color printer CP, it is possible to carry out printing by controlling only the printer after image data have been input to the printer. Thus, the load on the CPU of the host computer 3 is reduced, allowing the processing speed of the host computer 3 to be increased.

In this embodiment, the roll paper unit served as the printing medium unit, however, the printing medium unit can also be a paper cassette in which cut paper is accommodated or can be cut paper provided with a storage element.

Other Embodiments

In the foregoing, an embodiment of a printing apparatus, for example, according to the present invention was described. However, the foregoing embodiment of the present invention is for the purpose of facilitating understanding of the present invention and is not to limit the present invention. The invention can of course be altered and improved without departing from the gist thereof, and it is without saying that the present invention includes functional equivalents thereof.

The printing apparatus was described using an inkjet-type color printer as an example, however, it is also possible for the printing apparatus to be another type of printer having detachable units, and the printing apparatus can also be configured including a printer and a computer connected to the printer.

The foregoing embodiment was described using as an example a computer system in which the color printer CP is connected to a communications line via the host computer 3, however, it is also possible to directly connect the color printer to a communications line and to obtain print control programs from servers by executing FTP commands using the control circuit 50 provided in the printer.

The printer according to the foregoing embodiment, which includes a main printer unit and a printing medium unit that can be removably mounted to the main printer unit, can also be provided with all or some of the functions of a main computer unit, a display device, an input device, a flexible disk drive device, and a CD-ROM drive device. For example, the printer can be configured so as to have an image processing section for carrying out image processing, a display section for carrying out various types of display, and a storage media attach/remove section to/from which storage media storing image data captured by a digital camera or the like can be attached and removed.

The foregoing embodiment was described using as an example a color printer CP capable of using both cut paper and the roll paper unit 30, however, the printing apparatus according to the present invention can also be adopted for printers that exclusively use roll paper.

With the present embodiment, it is possible to achieve a printing apparatus and a printing method with which print control programs can be acquired via a communications line by mounting an ink container, a printing medium, and a print head.

<<<Second Embodiment >>>

Schematic Configuration of Printing Apparatus

Figure 18:
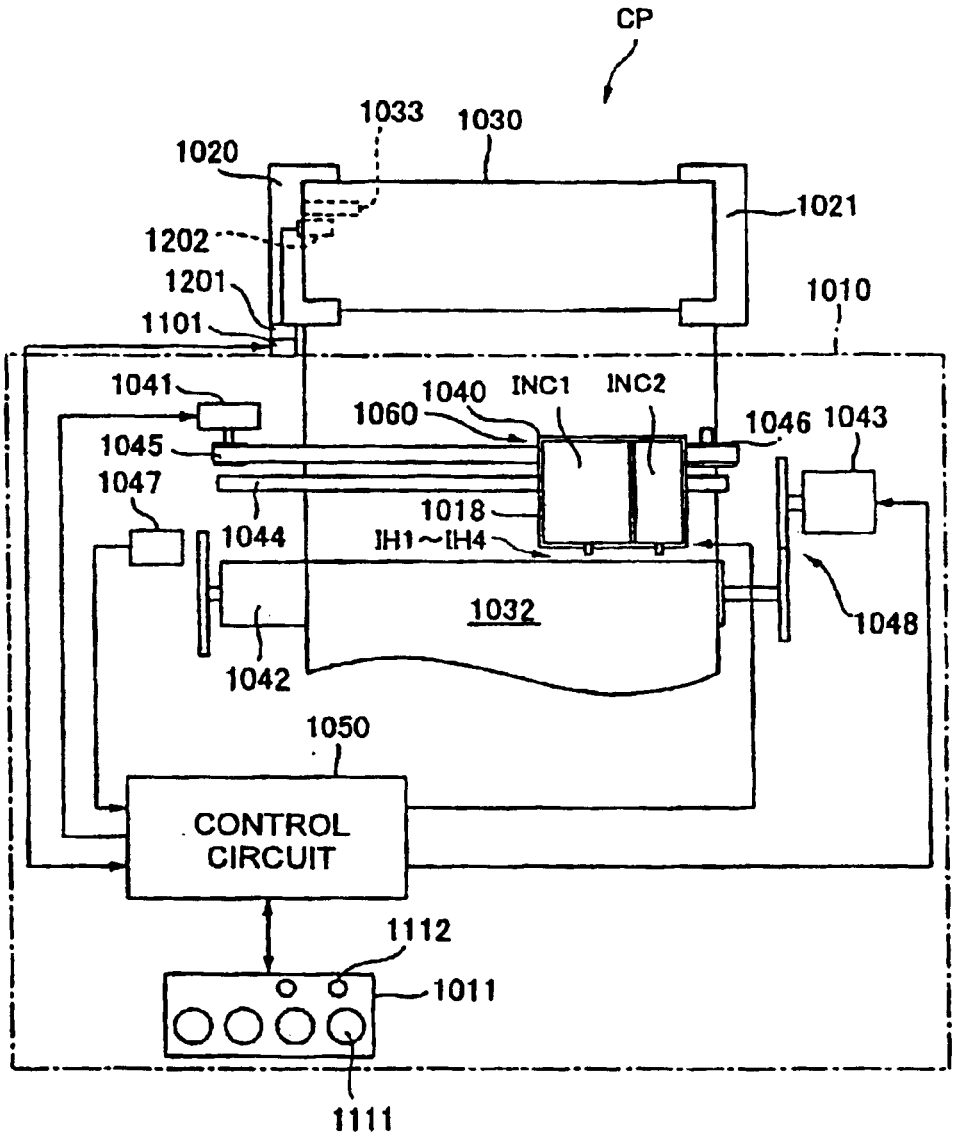
FIG. 18 is a diagram showing the overall configuration of a printing apparatus according to the second embodiment.

First, an outline of primarily the outside structure of a printing apparatus according to a second embodiment is described with reference to FIG. 18. FIG. 18 schematically shows the configuration of a printing apparatus according to the second embodiment.

FIG. 18 shows a color printer CP as an example of the printing apparatus. It should be noted that the color printer CP has a main printer unit 1010 serving as the printing apparatus main unit, and a roll paper unit 1030 serving as a printing medium unit that is removably mounted to the main printer unit 1010.

The color printer CP is capable of printing color images, and is for example an inkjet-type printer for forming images by ejecting four colors of color ink, such as cyan (C), magenta (M), yellow (Y), and black (K), onto a printing medium such as roll paper so as to form dots. It should be noted that in addition to these four colors it is also possible to use light cyan (LC), light magenta (LM), and dark yellow (DY) as the color ink.

As shown in FIG. 18, the color printer CP has a structure in which a printing medium, such as paper for printing, that is supplied from its rear side is discharged from its front side. The front side of the main printer unit 1010 is provided with an operation panel 1011 and a paper discharge section 1012, and its rear side is provided with a paper supply section 1013. The operation panel 1011 is provided with a variety of operation buttons 1111 and display lamps 1112. The paper discharge section 1012 is provided with a paper discharge tray 1121 blocking the paper discharge opening when not in use. The paper supply section 1013 is provided with a paper supply holder 1131 for holding cut paper (not shown), and roll paper unit holders 1020 and 1021 for holding the roll paper unit 1030.

Internal Configuration of the Color Printer CP

Figure 19:
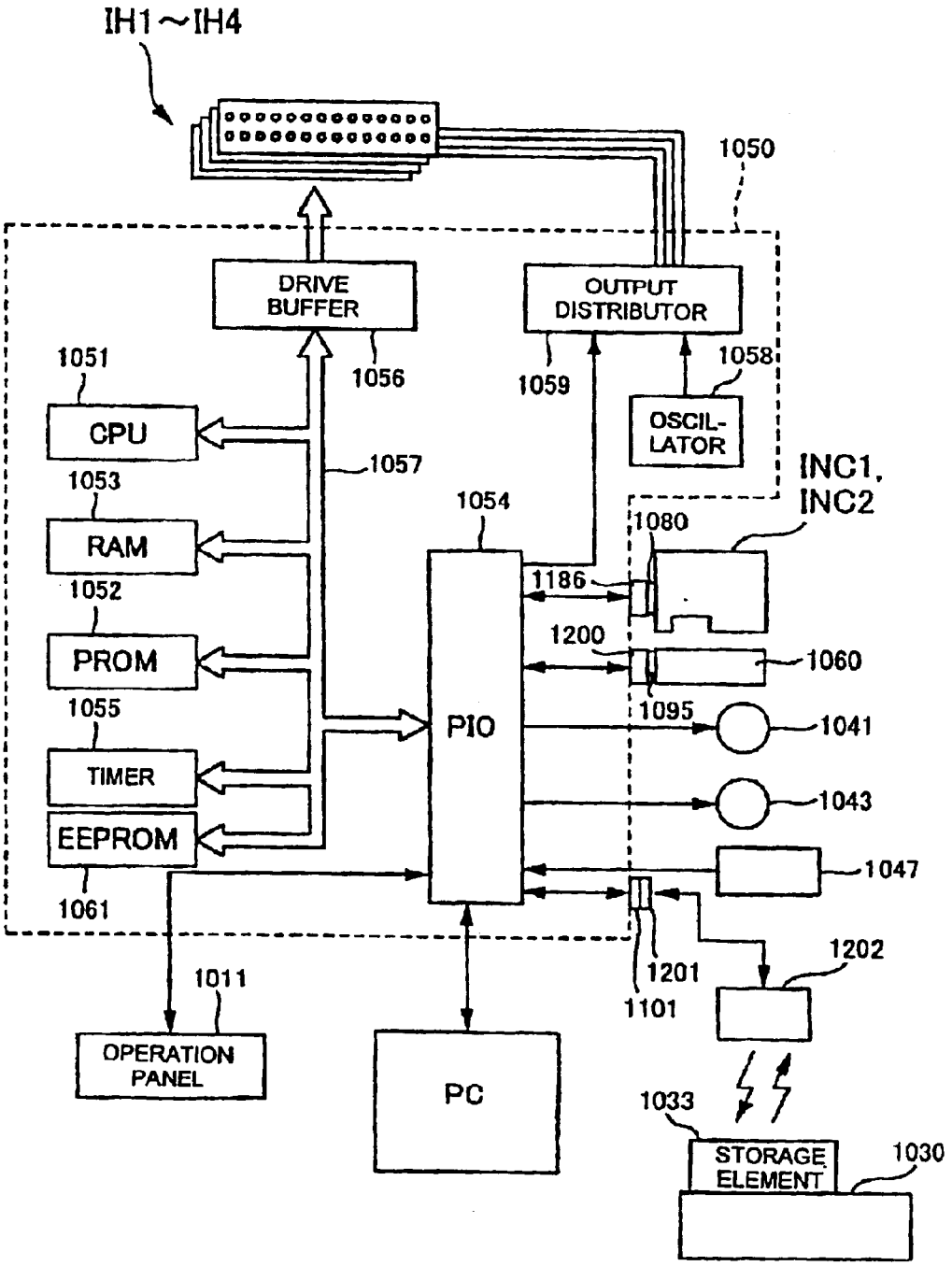
FIG. 19 is a diagram showing the internal configuration of the color printer CP according to the second embodiment.

Next, the internal configuration of the color printer CP is described with reference to FIG. 19. FIG. 19 shows the internal configuration of the color printer CP according to the second embodiment.

As shown in the drawing, the color printer CP has a mechanism for ejecting ink and forming dots by driving print heads IH1 to IH4 of the print head unit that is provided in a carriage 1040 and that can be removably mounted, a mechanism for moving the carriage 1040 back and forth in the axial direction of a platen 1042 by a carriage motor 1041, a mechanism for transporting the roll paper for printing 1032 that is supplied from the roll paper unit 1030 by a paper-feed motor 1043, and a control circuit 1050.

The mechanism for moving the carriage 1040 back and forth in the axial direction of the platen 1042 includes a slide shaft 1044, which is provided parallel to the axis of the platen 1042 and which slidably holds the carriage 1040, and a pulley 1046 with an endless drive belt 1045 provided stretched between it and the carriage motor 1041.

The mechanism for transporting the roll paper for printing 1032 that is supplied from the roll paper unit 1030 includes the platen 1042, the paper-feed motor 1043 for rotating the platen 1042, a paper supply auxiliary roller, which is not shown, a gear mechanism 1048 for transmitting the rotation of the paper-feed mechanism 1043 to the platen 1042 and the paper supply auxiliary roller, and an encoder 1047 for detecting the rotation angle of the platen 1042. Also, a contact 1101 is provided on the main printer unit 1010 in opposition to a contact 1201 that is provided on the roll paper unit holder 1020.

The control circuit 1050 appropriately controls the movement of the paper-feed motor 1043, the carriage motor 1041, and the print heads IH1 to IH4 when a print command signal is input from the operation panel 1011 of the printer or from a personal computer PC to which the printer is connected. The roll paper for printing 1032 of the roll paper unit 1030, which is held by the roll paper unit holders 1020 and 1021 of the color printer CP, is set so that it is sandwiched between the platen 1042 and the paper supply auxiliary roller, and is fed by just a predetermined amount corresponding to the rotation angle of the platen 1042.

A print head unit 1060 and a cartridge mount section 1018, which is provided as a single unit with the print head unit 1060, are fastened to the carriage 1040, and ink cartridge INC1 and an ink cartridge INC2 serving as ink containers are mounted to the cartridge mount section 1018. Each ink cartridge INC1 and INC2 is provided with a storage element 1080 (see FIG. 23) for storing the ink type and the amount of ink remaining, for example, in addition to a program, which is described later. The ink cartridge INC2 holds black (K) ink, and the ink cartridge INC1 holds the other inks, that is, it holds three colors of ink: cyan (C), magenta (M), and yellow (Y). As has been mentioned already, it may also contain light cyan (LC), light magenta (LM), and dark yellow (DY) ink.

Internal Structure of the Control Circuit 1050

Figure 20:
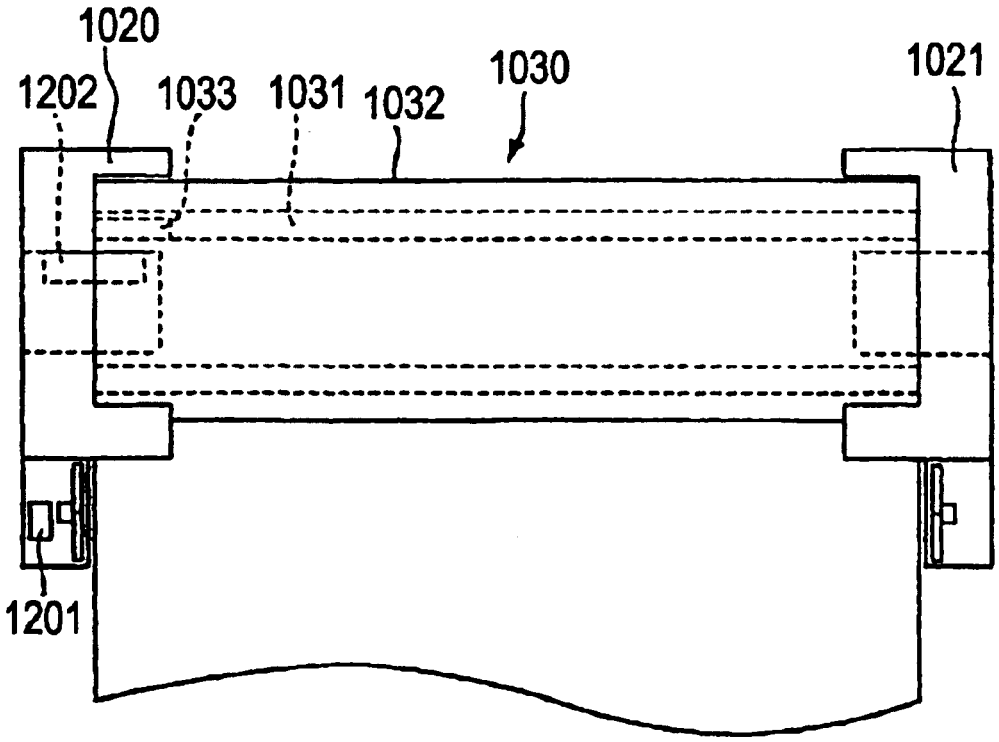
FIG. 20 is a block diagram showing the internal configuration of a control circuit 1050 of the color printer CP according to the second embodiment.

Next, the internal configuration of the control circuit 1050 of the color printer CP is described with reference to FIG. 20. FIG. 20 is a block diagram showing the internal configuration of the control circuit 1050 of the color printer CP according to the second embodiment.

As shown in FIG. 20, a CPU 1051, a PROM 1052, a RAM 1053, an EEPROM 1061, a periphery device input/output section (PIO) 1054, a timer 1055, and a drive buffer 1056, for example, are provided inside the control circuit 1050.

Various types of information are stored on the EEPROM 1061, but in this embodiment in particular, a data table indicating print control programs suited for the combination of the roll paper 1032, the ink, and the print heads IH1 to IH4 is stored, and can be rewritten if necessary. Also, the EEPROM 1061 is provided with a memory region in which print control programs have been appropriately written. The data table and the print control programs are described in detail later.

The PIO 1054 is connected to the personal computer PC, a connecter 1186 connecting it with the storage elements 1080 of the ink cartridges INC1 and INC2, a connector 1200 connecting it with a storage element 1095 of the print head unit 1060, the carriage motor 1041, the paper-feed motor 1043, the encoder 1047, and a transmit/receive section 1202 via the contacts 1101 and 1201. The drive buffer 1056 is used as a buffer for supplying on/off signals for dot formation to the print heads IH1 to IH4. These are connected to one another by a bus 1057 and can exchange data between one another.

The control circuit 1050 is also provided with an oscillator 1058 for outputting a drive waveform at a predetermined frequency, and an output distributor 1059 for distributing the output from the oscillator 1058 to the print heads IH1 to IH4 at a predetermined timing.

The control circuit 1050 accesses the storage element 1033 that is provided in a core material 1031 of the roll paper unit 1030, the storage elements 1080 that are provided in the ink cartridges INC1 and INC2, and the storage element 1095 that is provided in the print head unit 1060 when, for example, the power is turned on, when the roll paper unit 1030, the ink cartridges INC1 and INC2, and the print head unit 1060 are exchanged, and when the power is turned off. The information that is read from the storage element 1033 provided in the roll paper unit 1030, the storage elements 1080 that are provided in the ink cartridges INC1 and INC2, and the storage element 1095 that is provided in the print heads IH1 to IH4, is stored on the RAM 1053.

The control circuit 1050 controls the printing operation in response to the information that is obtained from the storage element 1033, the storage elements 1080, and the storage element 1095. The control circuit 1050 outputs dot data to the drive buffer 1056 at a predetermined timing while synchronizing the movement of the paper-feed motor 1043 and the carriage motor 1042. The processes in which the information that is obtained from the storage elements 1033, 1080 and 1095 is used are described in detail later.

Configuration of the Roll Paper Unit 1030 and the Storage Element 1033 Furnished Thereon The roll paper unit 1030 is provided with the core material 1031, the roll paper for printing 1032 that is wound around the outer circumference of the core material 1031, and the storage element 1033, which serves as a memory means, that is provided on the inner circumferential surface of the core material 1031. It should be noted that on the storage element 1033 are stored unit information on the characteristics, such as the water absorptivity, of the roll paper 1032 and the coefficient of friction, for example, of the printed surface, a suitability data table indicating a plurality of print control programs that are suited for the combination of various types of print heads and various types of inks based on the unit information and if printing is carried out using that roll paper, and various print control programs.

The roll paper unit holders 1020 and 1021 for holding the roll paper 1032 are arranged on either side of the rear side of the main printer unit 1010, forming a pair. One of the roll paper unit holders 1020 and 1021 (in the case of this embodiment, the roll paper unit holder 1020) is provided with the electrical contact 1201 between it and the main printer unit 1010 and the transmit/receive section 1202, which is electrically connected to the electrical contact 1201 and which is for sending and receiving data to and from the storage element 1033 of the roll paper unit 1030. It should be noted that in order to show the contact 1201 and the transmit/receive section 1202 that are provided on the roll paper unit holder 1020, the roll paper unit holders 1020 and 1021 are shown in FIG. 18 detached from the main printer unit 1010 and the roll paper unit 1030.

Here, in addition to print control programs, it is also possible to suitably store on the storage element 1033 information on the paper type indicating whether it is normal paper or photo paper, for example, information on the paper thickness, information on the paper color, information on the paper width, information on the paper quality, and information on the manufacturing date. In this case, the storage element 1033 can also have a rewritable region that stores information the roll paper and that allows data to be read and rewritten, and a non-rewritable region that stores the print control programs and that cannot be written.

Positional Relationship Between the Storage Element 1033 and the Send/Receive Section 1202

Figure 21:
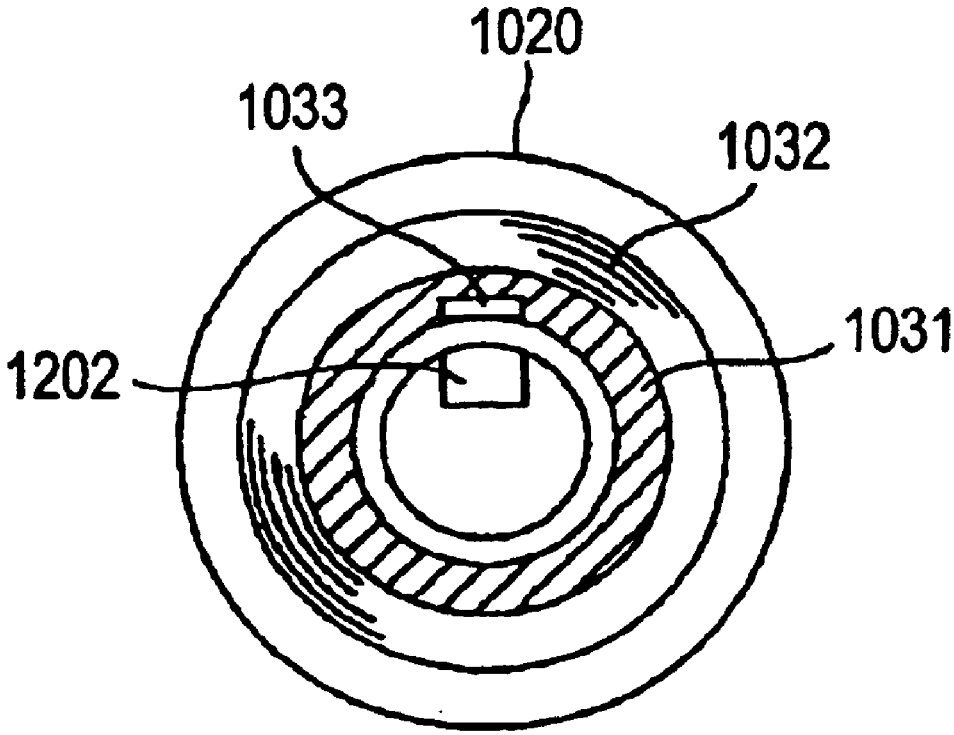
FIG. 21 is a diagram showing the positional relationship between a storage element 1033 and a transmit/receive section 1202 when a roll paper unit 1030 is held by roll paper unit holders 1020 and 1021.
Figure 22A:
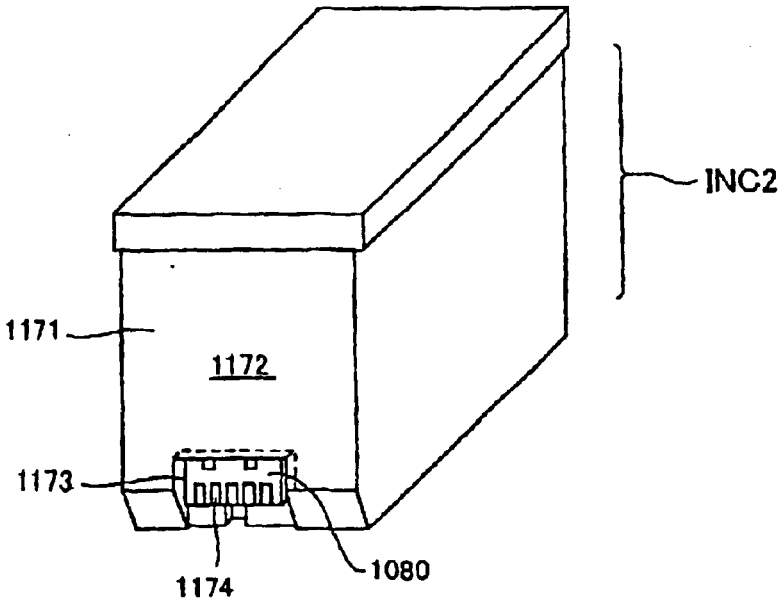
FIGS. 22A and 22B are lateral views of FIG. 21 seen from the side of the roll paper unit holder 1020.
Figure 22B:
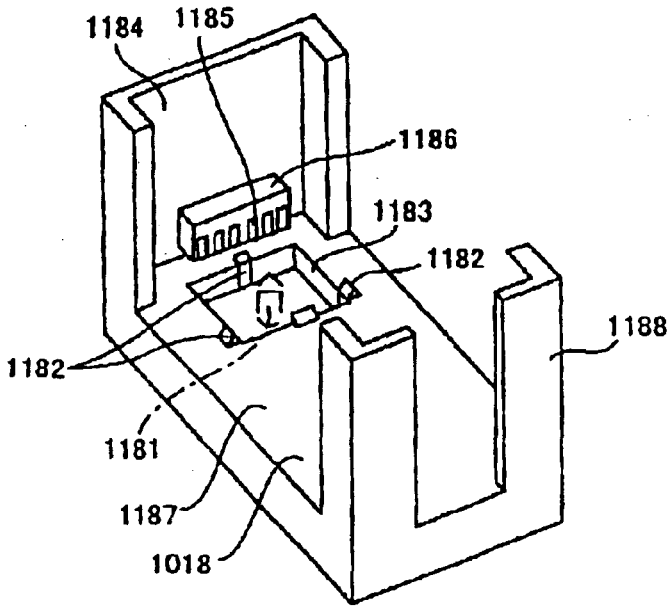

Next, the positional relationship between the storage element 1033 of the roll paper unit 1030 and the transmit/receive section 1202 of the roll paper unit holder 1020 is described with reference to FIGS. 21 and 22. FIG. 21 is a diagram showing the positional relationship between the storage element 1033 and the transmit/receive section 1202 in a state where the roll paper unit 1030 is held by the roll paper unit holders 1020 and 1021. FIG. 22 is a lateral view of FIG. 21 seen from the side of the roll paper unit holder 1020.

In this embodiment, a noncontact-type storage element is employed as the storage element 1033, so that it is not necessary for the storage element 1033 and the transmit/receive section 1202 to be in contact with one another when data are sent and received. Consequently, as shown in FIGS. 21 and 22, there is a space between the transmit/receive section 1202 and the storage element 1033. Also, with a noncontact-type storage element, carrier waves that are transmitted from an outside transmit/receive circuit are rectified so as to generate the required power.

Each time the roll paper unit 1030 makes one revolution the storage element 1033 of the roll paper unit 1030 is drawn closest to the transmit/receive section 1202 of the roll paper unit holder 1020. If a short range-type storage element with which transmission and reception are possible at a distance of about 2 mm is used as the storage element 1033, then data are transmitted and received when the storage element 1033 and the transmit/receive section 1202 are nearest to one another. Also, if a mid range-type storage element with which transmission and reception are possible at a distance of about 10 mm is used, then data can be sent and received irrespective of the relative positions of the storage element 1032 and the transmit/receive section 1202. It should be noted that it is of course also possible to employ a contact-type storage element as the storage element 1033. In this case, the roll paper unit holder 1020 is provided with a contact in place of the transmit/receive section 1202, and data are sent and received when the roll paper unit 1030 is rotated and the contact on the side of the roll paper unit holder 1020 comes into contact with the contact of the storage element.

Configuration of the Ink Cartridges and the Cartridge Mount Section 1018

The ink cartridges INC1 and INC2 serving as ink container units in the color printer CP share the same general structure. Accordingly, with the ink cartridge INC2 for black serving as an example, the structure of the ink cartridges and the structure for mounting these cartridges to the main printer unit 1010 are described with reference to FIGS. 23 and 24.

Figure 23:
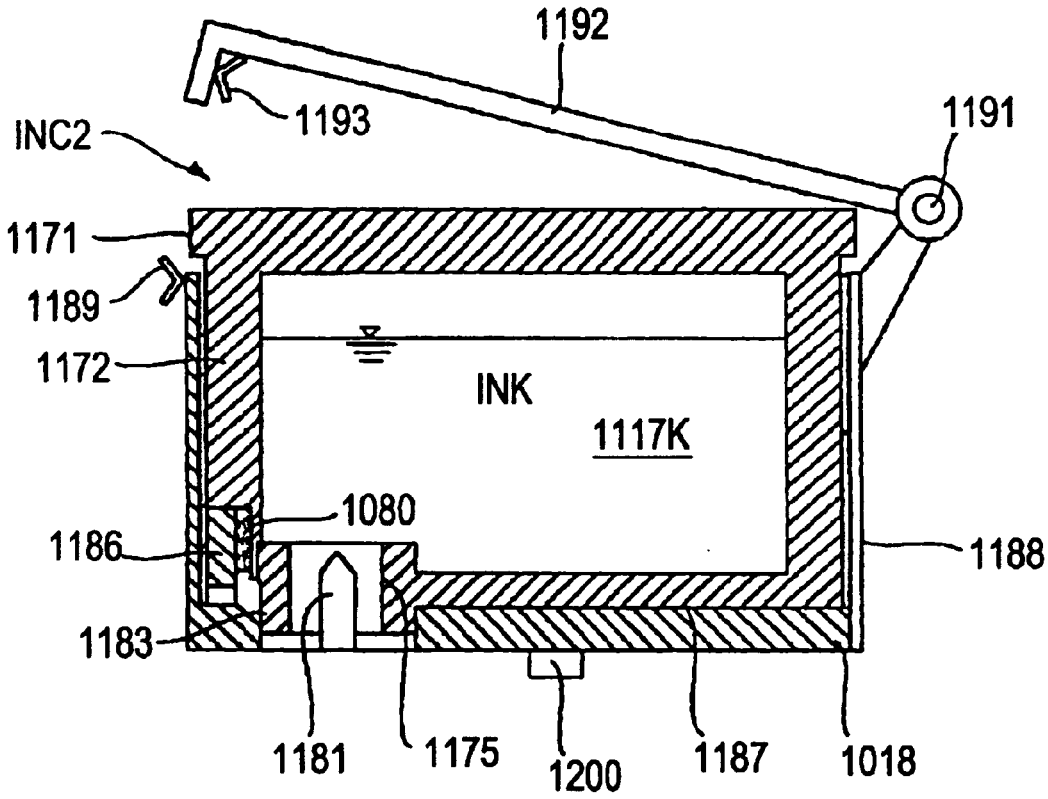
FIG. 23 is a perspective view showing the overall structure of ink cartridges and the cartridge mount section of a main printer unit 1010.
Figure 24:
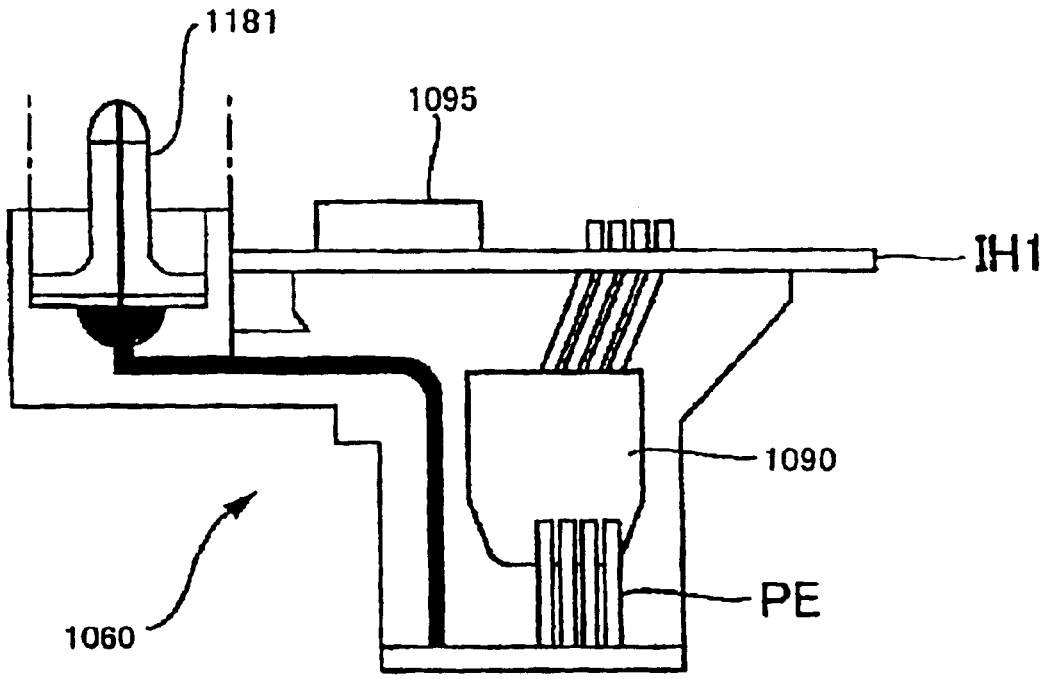
FIG. 24 is a cross-sectional view showing the internal structure of the ink cartridges, the internal structure of a cartridge mount section 1018 on a carriage 1040, and how the cartridge is mounted to the cartridge mount section 1018.

FIG. 23 is a perspective view that schematically shows the structure of an ink cartridge and the cartridge mount section 1018 of the main printer unit 1010. FIG. 24 is a cross-sectional view showing the internal structure of the ink cartridges, the internal structure of the cartridge mount section 1018 on the carriage 1040, and how the cartridge is mounted to the cartridge mount section 1018.

In FIG. 23, the ink cartridge INC2 is shown provided with a main cartridge unit 1171 that is made of synthetic resin and that constitutes an ink container section 1117K containing ink, and the storage element (memory means) 1080 provided inside a side frame section 1172 of the main cartridge unit 1171. The storage element 1080 sends and receives various data to and from the main printer unit 1010 when the ink cartridge INC 2 is mounted to the cartridge mount section 1018 of the main printer unit 1010. The storage element 1080 is fitted into a recessed section 1173 whose lower side with respect to the side frame section 1172 of the ink cartridge INC2 is open, and thus only the plurality of connection terminals 1174 are exposed.

On the other hand, the cartridge mount section 1018 is provided with an aperture 1183 in a bottom section 1187 of the space in which the ink cartridge INC2 is mounted, and an ink introducing tube 1181 of the print head IH1 that is mounted to the lower side of the cartridge mount section protrudes upward. An ink supply section 1175 that is formed in the ink cartridge INC2 is inserted into the aperture 1183, and cartridge guides 1182 are formed in three locations in the inner wall of the aperture 1183. A connector 1186 is arranged in an inner wall 1184 of the cartridge mount section 1018. A plurality of electrodes 1185 for electrically connecting to the plurality of connection terminals 1174 of the storage element 1080 when the ink cartridge INC2 is mounted into the cartridge mount section 1018 are formed in the connector 1186.

The procedure for fitting the ink cartridge INC2 to the cartridge mount section 1018 is described next. First, the ink cartridge INC2 is arranged in the cartridge mount section 1018. A fastening lever 1192 is attached to a rear wall section 1188 of the cartridge mount section 1018 via a support shaft 1191, and when the fastening lever 1192 is pulled down so that it covers the ink cartridge INC2, the ink cartridge INC2 is forced downward, fitting the ink supply section 1175 into the aperture 1183. At this time, the ink introduction tube 1181 of the print head unit 1060 mounted to the ink cartridge mount section 1018 is thrust into the ink supply section 1175, allowing ink to be supplied. Moreover, when the fastening lever 1192 is lowered, an interlocking section 1193 formed in the tip of the fastening lever 1192 engages an engaging member 1189 that is formed in the cartridge mount section 1018, fastening the ink cartridge INC2. In this state, the plurality of connection terminals 1174 of the storage element 1080 of the ink cartridge INC2 and the plurality of electrodes 1185 of the cartridge mount section 1018 are electrically connected to one another, allowing data to be sent and received between the main printer unit 1010 and the storage element 1080.

The structure of the ink cartridge INC2 is basically the same as the color ink cartridge INC1, and thus the ink cartridge INC1 will not be described. However, with the color ink cartridge INC1, three different color inks are filled into separate ink chambers, and it is necessary for these inks to be supplied to the print head along different routes. Consequently, with the color ink cartridge INC1, the number of ink supply sections 1175 that are formed corresponds to the number of ink colors. It should be noted that although the ink cartridge INC1 accommodates three colors of ink, it is internally provided with only one storage element 1080, and this single storage element 1080 collectively stores information on the ink cartridge INC1 and information on each color of ink.

Configuration of the Storage Elements 1080 Provided in the Ink Cartridges

The storage elements 1080 store unit information on the characteristics, such as the concentration, viscosity, and volatility, of the ink that is accommodated in that cartridge, a suitability data table indicating a plurality of print control programs that are suited for the combination of various types of print heads and various types of paper based on the unit information if printing is carried out using the ink, and various print control programs. Also, as the unit information, in addition to the print control programs it is also possible to appropriately store information on the type of ink, such as whether the ink is dye ink or pigment ink, information on ink characteristics such as the ink concentration, viscosity, and volatility, information on the remaining amount, and information on the manufacturing date of the ink, for example. In this case, the storage elements 1080 can also have a rewritable region that stores ink information and that allows data to be read and rewritten, and a non-rewritable region that stores the print control programs and that cannot be written.

Configuration of the Print Head Unit 1060

Figure 25:
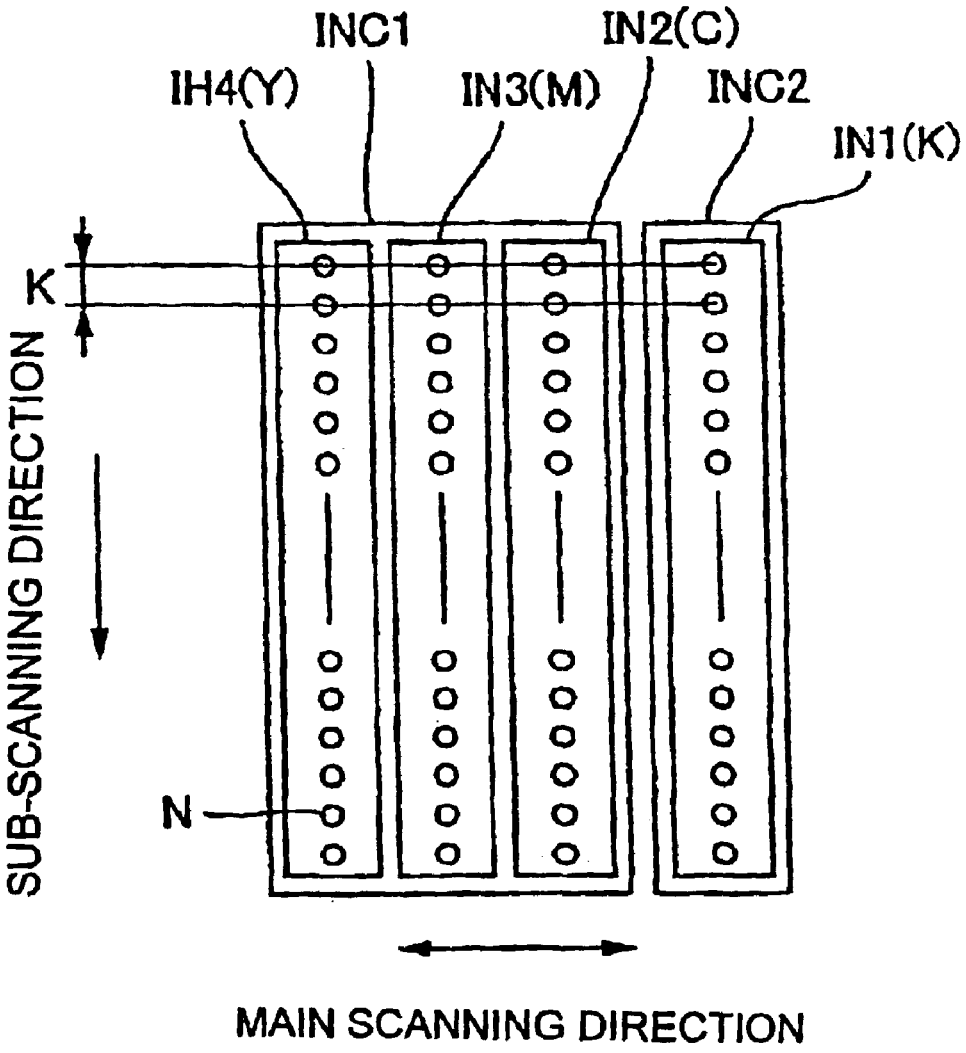
FIG. 25 is a cross-sectional view showing the overall structure of the print head unit 1060.
Figure 26:
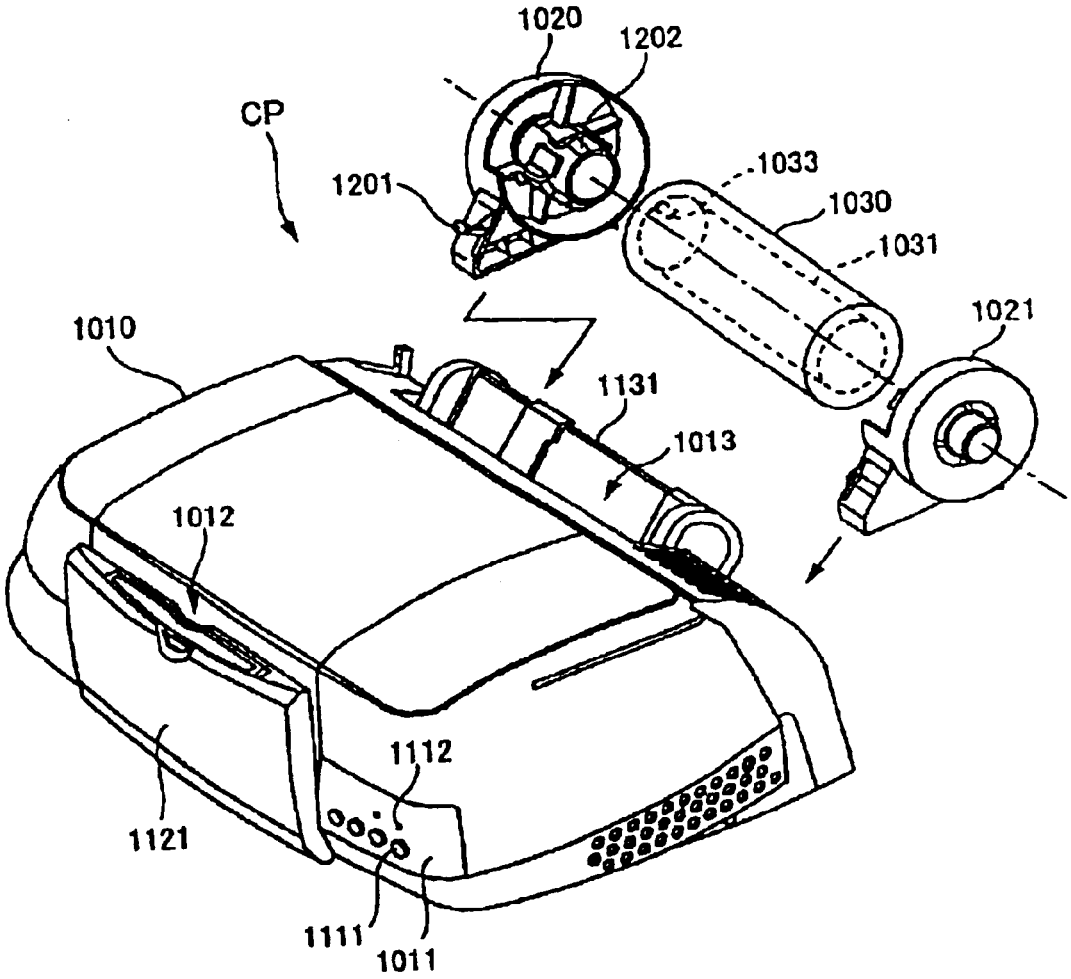
FIG. 26 is a diagram showing the arrangement of the nozzles N in the second embodiment.

FIG. 25 schematically shows a cross section of the print head unit 1060 provided below the ink cartridge mount section 1018. FIG. 26 is a diagram showing the arrangement of the nozzles provided in the print heads IH1 to IH4. The print head unit 1060 is configured as a single unit with the ink cartridge mount section 1018, and is provided in the carriage 1040 shown in FIG. 19.

The print head unit 1060 is provided with a plurality of nozzles N, which are arranged in a row for each ink color and serve as ink-ejecting sections, piezo elements PE provided in each nozzle N, an actuator circuit 1090 that drives the piezo elements PE in correspondence with head drive signals, and the storage element (memory means) 1095 provided in an upper section of the print head unit 1060.

When the print head unit 1060 is mounted to the carriage 1040 of the main printer unit 1010, the storage element 1095 is connected to the connector 1200 provided in the carriage 1040 and sends and receives various data with respect to the main printer unit 1010 via a flexible cable connecting the carriage 1040 and the control circuit 1050.

As shown in FIG. 26, each print head IH1 to IH4 is provided for a color, and 96 nozzles are arranged in each print head in a line with a constant nozzle pitch (ejection section spacing) k between them in the sub-scanning direction, that is, in the direction in which paper is fed. The nozzle pitch k is set to an integer multiple the resolution of the printed picture in the sub-scanning direction (dot pitch), and here is set to approximately 141 $\mu$m to correspond to a 180 dpi.

When the ink cartridges INC1 and INC2 are installed, the ink in the ink cartridges INC1 and INC2 is supplied from the ink introduction tube 1181 to the print head unit 1060 through capillary action. On the other hand, a common drive signal that is adopted for all the nozzles N is generated in the print head drive circuit within the control circuit 1050 and is supplied to the print heads IH1 to IH4. The actuator 1090, in accordance with a print signal PS that is supplied from the personal computer PC, latches the data for each nozzle N indicating whether that nozzle is on (ejecting ink) or off (not ejecting ink), and for only the on nozzles N, transmits the common drive signal that is applied from the print head drive circuit to the corresponding piezo element PE arranged in contact with the ink route. Voltage is applied to the piezo elements PE by the common drive signal, and as is well known in the art, the crystalline structure of the piezo elements is deformed and quickly expands, increasing the volume of the ink route and allowing an amount of ink corresponding to that increase to be ejected from the nozzle N.

The storage element 1095 stores unit information on the density, number, and diameter, for example, of the nozzles provided in the print heads IH1 to IH4, a suitability data table indicating a plurality of print control programs that are suited for the combination of various types of inks and various types of paper based on the unit information and if printing is carried out using the print heads IH1 to IH4, and various print control programs. Also, in addition to the print control programs, the storage element 1095 can also be suitably provided with print head information on the spacing, number, and diameter of the nozzles, and in this case, the storage element 1095 can also have a rewritable region that stores print head information and that allows data to be read and rewritten, and a non-rewritable region that stores the print control programs and that cannot be rewritten.

Print Control Program

The print control program is a program for printing to a printing medium by ejecting ink from the print heads IH1 to IH4 based on the image data. The print control program is for example a program for suitably ejecting ink from predetermined nozzles N of the print head unit 1060 based on image data created by a printer driver that has been installed in the personal computer PC, and includes a rasterizing program and a raster-row conversion program. The print control program can also include an image progressing program for halftone processing, color conversion processing, or multithresholding, for example, which are well known in the art, and it may also include a printer driver if necessary.

The image data that are input are developed into a matrix consisting of the number of dots in the main-scanning direction and the number of dots in the sub-scanning direction to match the degree of resolution that has been designated by the user, and are also color separated by ink color and stored on a buffer. Based on the data for each line in the main-scanning direction of the image data (called the "raster data"), ink is ejected from predetermined nozzles N of the print heads IH1 to IH4, which are scanned in the main-scanning direction, to form the image. Consequently, 96 main-scan lines can be printed by scanning the print heads IH1 to IH4 a single time because the 96 nozzles are arranged in a line in the sub-scanning direction on the print heads IH1 to IH4.

As mentioned above, a rasterizing program refers to a program that executes a process for converting, for each nozzle, data to be printed into data indicating the locations where dots are to be formed by that nozzle. With a rasterizing program, for example, if an image is printed both forward and backward in the main-scanning direction, then the arrangement of the image data is reversed to correspond to the main-scanning direction. Also, if each raster is formed using two nozzles, that is, if "overlap recording" is performed, then the image data are rearranged so that the data of odd-numbered pixels are supplied to one nozzle and the data of even-numbered pixels are supplied to the other nozzle. At this time, mask data are inserted at even-numbered pixels for the nozzles that form only odd-numbered pixels.

The rasterizing programs of the present embodiment include a program for rearranging raster data so as to allow the image data to be printed by the print heads IH1 to IH4 if the dot pitch corresponding to the resolution of the image data stored on the buffer is different than the nozzle pitch k of the print heads IH1 to IH4 that are equipped, and a program for controlling the location of the dots that are printed in each scan if the raster data for a single line are not printed by scanning the print heads IH1 to IH4 a single time but rather are printed by scanning them a plurality of times.

More specifically, if the user sets the image resolution to 360 dpi (dot pitch of approximately 70.6 $\mu$m) and image data corresponding to this are input, then when the raster data of the first line of the image data are printed by the first nozzle of a print head with a nozzle pitch of 141 $\mu$m and the raster data of the second line are printed by the second nozzle of the same print head, the length in the sub-scanning direction is doubled and the image resolution becomes 180 dpi, making it impossible to print the requested image. For this reason, a program for rearranging the raster data rearranges the raster data so that, for example, if printing is performed using print heads having four nozzles in the sub-scanning direction, then the raster data of the first, third, fifth, and seventh lines are correlated to the nozzle row from the top in that order and are printed when the print heads IH1 to IH4 are scanned for the first time. Then, after the paper has been moved approximately 70.6 $\mu$m in the sub-scanning direction by the paper-feed motor, the raster data of the second, fourth, sixth, and eighth lines are correlated to the nozzle row from the top in that order and are printed when the print heads IH1 to IH4 are scanned for the second time. A program for controlling the locations of the dots is adopted if, for example, based on the characteristics of the ink and the paper, there is a risk that blotting will occur and lower the image quality when ink is ejected to a location near dot that have been ejected but have not dried. In other words, such a program rearranges the raster data into the order in which they are to be printed in each scan of the print heads IH1 to IH4 if a single line of raster data are printed by printing leaving the dot spacing in the main-scanning direction when the print heads IH1 to IH4 are scanned for the first time, advancing the paper to correspond to the printing resolution, then scanning the print heads IH1 to IH4, and while repeating this, printing the space between the dots.

The raster-row conversion program is a program for associating the image data that are rasterized as mentioned above with the number of nozzles that are used in the nozzle row, which is formed in the sub-scanning direction, and then writing them to an intermediate buffer in order from the start of the raster data. That is, it is a program for converting raster (scan line) data into row data. Here, one example of a raster-row conversion program stored on the storage elements is a program for raster-row conversion of the image data based on the print operation and/or the specification of the print heads that are installed when one row of pixel data is to be printed if, for example, the number of pixel data in one nozzle row of the print heads is different than the number of nozzles in one row of the nozzle row of the print heads. At this time, among the rasterizing programs, it is also possible for the raster-row conversion program to include some of the programs relating to the number of nozzles, for example.

The print control programs, including the rasterizing programs and the raster-row conversion programs, are programs that correspond to the characteristics of the ink container, the printing medium, and the print heads, for example.

Consequently, if the storage element is provided in an ink container, then it is preferable that the print control program is a program that takes into account the tendency of the ink accommodated in the ink container to blot.

Also, if the storage element is provided in the printing medium, then it is preferable that the print control program is a program that takes into account the coefficient of friction or the ability to absorb ink of the printing medium.

Also, if the storage element is provided in the print heads, then the print control program is preferably a program that takes into account the number of ink-ejecting sections provided in the print heads or the distance between the ink-ejecting sections.

It should be noted that the print control programs can also be programs that are correlated to the tendency of the ink accommodated in the ink container to blot, the coefficient of friction of the printing medium or its ability to absorb ink, or the number of ink-ejecting sections provided in the print heads or the distance between the ink-ejecting sections, regardless of where the storage elements are provided.

The programs that are suitable for the rasterizing program and the raster-row conversion program differ depending on the nozzle pitch of the print heads and the characteristics of the ink and the paper, for example, or depending on whether the request of the user prioritizes printing speed or image quality. Consequently, the program that is set is appropriate for the print heads, the ink, the paper, and the combination of the three.

Combination of Print Heads, Ink, and Paper, and Setting the Print Control Program FIG. 27 is a diagram showing an example of a data table stored on the PROM 1052 in advance.

FIG. 27 shows a type selection data table for selecting from three print control programs (type P1, type P2, type P3) suited for the combination of three types of paper (paper α, paper β, paper γ), three-types of ink (ink a, ink b, ink c), and type A print heads IH1 to IH4, which are installed in the main printer unit 1010. For example, the type P1 print control program which is suited for the print heads IH1 to IH4 that have been equipped, is selected if ink cartridges INC1 and INC2 accommodating the ink a are installed and a roll paper unit 1030 with the paper α is set.

FIG. 28 is a program specification data table indicating the combination of the rasterizing programs and the raster-row conversion programs that correspond to the type of print control program that is selected from the type selection table. When type P1 is selected as in the above example, then the rasterizing program (1) and the raster-row conversion program (1) are specified according to the program specification data table, and these programs are used to carry out printing.

For example, blotting is more apt to occur when ink a is used to print to paper α, whereas blotting is less likely to occur when ink c is used to print to paper γ. At this time, the rasterizing program (1) that is specified by type P1 is a program for printing one line of raster data every three dots, such as printing one line of raster data while the print heads are scanned four times, and the raster-row conversion program (1) is a program for correlating the raster data in order from the first nozzle so as to match the number of nozzles in the nozzle row. On the other hand, the rasterizing program (3) that is specified by type P3 is for example a program for sequentially printing adjacent dots, and the raster-row conversion program (1) is the same program as described above because the print heads are the same.

When the control circuit 1050 accesses the storage elements 1033, 1080, and 1095 provided in the print head unit 1060, the ink cartridges INC1 and INC2, and the roll paper unit 1030, respectively, the data tables that are stored on the storage elements 1033, 1080, and 1095 that are accessed are read out, and if necessary, the data table in the PROM 1052 is rewritten. At this time, if print control programs corresponding to the data table are not stored on the PROM 1052, then print control programs stored on the storage elements 1033, 1080, and 1095 of the print head unit 1060, the ink cartridges INC1 and INC2, and the roll paper unit 1030, respectively, are downloaded, or the addresses at which the programs are stored are recorded.

Printing Operation Using the Color Printer CP

Figure 31:
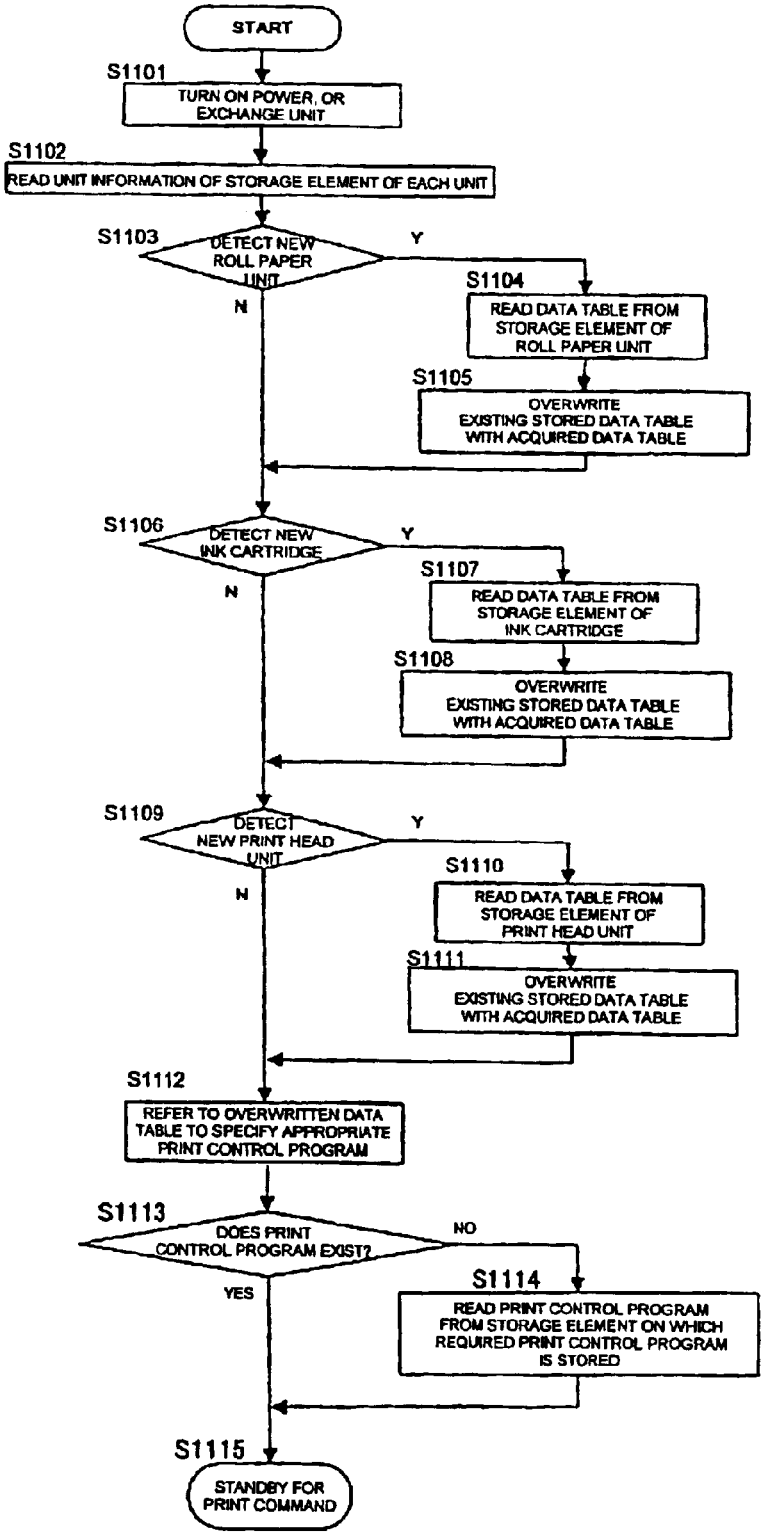
FIG. 31 is a flowchart showing the method for reading print control programs, for example, stored on the storage elements.

Next, a printing operation using the color printer CP according to the second embodiment is described with reference to FIG. 31. FIG. 31 is a flowchart showing the operation for reading out print control programs or the like stored on the storage elements.

After the power is turned on or after the user performs the task of exchanging the roll paper unit 1030, the ink cartridges INC1 and INC2, and/or the print head unit 1060 (S1101), the color printer CP reads out the unit information that is stored on the storage element 1033 provided in the roll paper unit 1030, the storage elements 1080 provided in the ink cartridges INC1 and INC2, and the storage element 1095 that is provided in the print head unit 1060 (S1102). At this time, if all the unit information in the storage elements 1033, 1080, and 1095 coincides with the information that is already stored on the EEPROM 1061, then after predetermined initializing operations are performed, the color printer CP enters a standby state in which it waits for a printing command from an outside PC, for example (S1115).

On the other hand, if the unit information in any of the storage elements 1033, 1080, and 1095 includes information different than the information that is already stored on the EEPROM 1061 (S1103, S1106, S1109), then the unit information and a suitability data table indicating a plurality of programs that are suited for the combination of the units if the units are used to carry out printing are read from the storage element on which this information is stored (S1104, S1107, S1110), and the data table that is already stored is overwritten with the suitability data table that is read out (S1105, S1108, S1111).

Then, referencing the data table that has been newly written, the print control program that is suited for the combination of the roll paper unit 1030, the ink cartridges INC1 to INC4, and the print head unit 1060 that are installed is specified (S1112). It should be noted that unit information for identifying each unit is used at the time of this specification. Next, if the print control program that has been specified is not stored on the memory of the main printer unit 1010 (S1113), then the specified print control program is read from any of the storage elements 1033, 1080, and 1095 on which the specified print control program is stored, and is stored on the EEPROM 1061 (S1114).

In the following illustrative example, the user has exchanged the print head unit of the type mentioned above, which has a nozzle pitch of approximately 141 μm (corresponds to 180 dpi), with a type B print head unit, which has a nozzle pitch of approximately 70.6 μm(corresponds to 360 dpi). When the user has finished the task of exchanging the print head units and closes the outside cover, for example, a signal indicating that the exchange of the print head units has finished is received by the control circuit 1050 (S1101), which then reads the unit information from the storage element 1095 of the print head unit (S1102). When it is consequently recognized that a new print head unit (type B) has been installed (S1109), a type selection data table, which is a suitability data table indicating a plurality of print control programs that are suitable with the combination of various types of inks and various types of paper if printing is performing using the type B print head unit, and a program specification data table are obtained from the storage element 1095 of the print head unit (S1110), and the data tables that are already stored are overwritten (S1111). FIGS. 29 and 30 show examples of suitability data tables stored on a type B print head unit.

In a case where the roll paper of the roll paper unit 1030 that is fitted into the color printer CP is the paper α or the paper β and the ink of the ink cartridges INC1 to INC4 is the ink a or the ink b, then printing is possible using one of the already stored print control programs P1 to P3, and thus the color printer CP is in a state of standby in which it waits for a print command (S1115).

On the other hand, in a case where the roll paper of the roll paper unit 1030 that is fitted into the color printer CP is the paper γ or the ink of the ink cartridges INC1 to INC4 is the ink c, then a new print control program P4 is appropriate, as shown in the suitability data table of FIG. 29. The print control program P4 includes the rasterizing program (4) and the raster-row conversion program (1), and the rasterizing program (4), which was not stored when the type A print head unit 1060 was equipped, becomes necessary (S1113). Thus, the control circuit accesses the storage element 1095 of the newly installed print head unit and reads out the rasterizing conversion control program (4) that is stored on the storage element 1095 (S1114) and stores it in the EEPROM 1061, putting the color printer CP in the standby state (S1115). Here, the rasterizing program (4) is for a case in which the nozzle pitch 70.6 μm of the type b print head unit matches the dot spacing of the 360 dpi image resolution specified by the user, and is a program for converting data so that raster data are sequentially correlated to the nozzles from the top of the nozzle row, so that raster data of the first line, which corresponds to the top of an image, are printed by the first nozzle of the print head and the raster data of the second line are printed by the second nozzle of the same print head. The example shown here was one in which the print heads were exchanged, however, print control programs are specified and obtained in the same manner if the ink cartridge, the roll paper unit, or a combination of these is exchanged.

With the printing apparatus of the present embodiment, even if any of the roll paper unit 1030, the ink cartridges INC1 and INC2, and the print head unit 1060 are exchanged and a print control program that is suited for these does not exist in the color printer CP, a superior image can be printed because the most suitable print control program is specified based on the unit information, the suitability data tables, and the print control programs that are stored on the storage elements 1033, 1080, and 1095 of the roll paper unit 1030, the ink cartridges INC1 and INC2, and the print head unit 1060, respectively, and the specified print control program can be acquired through these units.

In the storage element 1033 of the roll paper unit 1030 it is also possible to store correction information for optimizing the feed amount of the roll paper 1032, if the roll paper 1032 is used, based on the coefficient of friction of the roll paper 1032, a suitability data table between the roll paper unit and the printer in which it is installed, and printer drivers having different feed amounts for the roll paper 1032 to serve as the print control programs that are selected based on the suitability data table. By doing this, the printer driver with which the roll paper is most suitably fed is read out to the main printer unit 1010 when the roll paper is fitted, and by feeding the paper to correspond to the roll paper that has been fitted, ink is ejected at the correct locations, allowing a higher quality image to be printed.

In this embodiment, an example was shown in which only a rasterizing program that has become necessary due to the installation of a new print head unit is read from the storage element of that print head unit, however, it is also possible to read all print control programs that are stored on the storage element. Additionally, it is not absolutely necessary that the print control programs are read to the main printing unit 1010, and only the address of storage elements on which required print control programs are stored may be written to the RAM 1053, and, if necessary, the storage elements 1033, 1080, and 1095 can be accessed so as to execute the program.

It is also possible that the print control programs that are stored on the storage elements 1033, 1080, and 1095 are not only the print control programs that are required for printing using the roll paper unit 1030, the ink cartridges INC1 and INC2, and the print head units 1060 in which the storage elements 1033, 1080, and 1095 are respectively provided, and when all print control programs that are required for printing using the color printer CP are stored, once the image data are input to the printer, it is possible to carry out printing by controlling only the printer. Thus, the load on the CPU of the personal computer PC is reduced and the processing speed of the personal computer PC can be increased.

In this embodiment, the roll paper unit served as the printing medium unit, however, the printing medium unit can also be a paper cassette in which cut paper is accommodated or can be cut paper provided with a storage element.

Other Embodiments

In the foregoing, an embodiment of a printing apparatus, for example, according to the present invention was described, however, the foregoing embodiment of the present invention is for the purpose of elucidating the present invention and is not for the purpose of limiting the present invention. The invention can of course be altered and improved without departing from the gist thereof and includes functional equivalents.

The printing apparatus was described using an inkjet-type color printer as an example, however, the printing apparatus may also be another type of printer having detachable units, and the printing apparatus can also be configured including a printer and a computer connected to the printer.

It is also possible to achieve a computer system that is provided with the printer according to the foregoing embodiment, which has a main printer unit and a printing medium unit that is removably mounted to the main printer unit, a main computer unit, a display device such as a CRT, input devices such as a mouse and a keyboard, a flexible drive device, and a CR-ROM drive device. As an overall system, the computer system achieved in this manner is superior to conventional systems.

The printer according to the foregoing embodiment, which includes a main printer unit and a printing medium unit that can be removably mounted to the main printer unit, can also be provided with all or a portion of the functions of a main computer unit, a display device, an input device, a flexible disk drive device, and a CD-ROM drive device. For example, the printer can be configured so as to have an image processing section for carrying out image processing, a display means for carrying out various types of display, and a storage media attach/remove section to which storage media on which are stored image data captured by a digital camera or the like are attached and can be removed from.

The foregoing embodiment was described using as an example a color printer CP capable of using both cut paper and the roll paper unit 1030, however, the printing apparatus according to the present invention can also be adopted for printers that exclusively use roll paper.

With the present embodiment, it is possible to achieve a printing apparatus and a printing method with which print control programs can be supplied to the user through an ink container, a printing medium, and a print head.

Although preferred embodiments of the present invention have been described in detail, it should be understood that various changes, substitutions and alterations can be made therein without departing from the spirit and scope of the inventions as defined by the appended claims.

What is claimed is:

1. A printing apparatus that can be connected to a communications line, the printing apparatus comprising:

an ink container for containing ink;

a printing medium that is capable of being printed with ink in said ink container; and a print head for ejecting ink onto the printing medium; wherein, at least one of said ink container, said printing medium, and said print head can be attached to and removed from a main unit of the printing apparatus together with a memory, and an acquisition program for acquiring, via the communications line, a print control program for printing on the printing medium by causing ink to eject from said print head based on image data, is stored on said memory.

2. A printing apparatus according to claim 1, wherein said print control program is stored on a predetermined server connected to said communications line, and said acquisition program acquires said print control program from said server.

3. A printing apparatus according to claim 1, wherein said printing apparatus is connected to said communications line via a host computer, and said acquisition program acquires said print control program via said host computer.

4. A printing apparatus according to claim 1, wherein said print control program is a program that matches a characteristic of the unit provided with the memory on which the acquisition program is stored.

5. A printing apparatus according to claim 1, wherein said print control program is a program for performing raster-row conversion processing.

6. A printing apparatus according to claim 1, wherein said print control program is a program for performing rasterization processing.

7. A printing apparatus according to claim 1, wherein if said memory is provided in or on said ink container, then said print control program is a program that matches a tendency of the ink contained in said ink container to blot.

8. A printing apparatus according to claim 1, wherein if said memory is provided in or on the printing medium, then said print control program is a program that matches a coefficient of friction or an ability to absorb ink of the printing medium.

9. A printing apparatus according to claim 1, wherein if said memory is provided in or on said print head, then said print control program is a program that matches a number of ink-ejecting sections provided in the print head or a distance between the ink-ejecting sections.

10. A printing apparatus according to claim 1, wherein at least two of said ink container, said printing medium, and said print head are attachable/removable together with memories provided in or on each of the two, unit information for identifying the unit in or on which the memory is provided is stored on each said memory, and by referring to a suitability data table indicating suitability between each of said units, a print control program is specified based on the unit information.

11. A printing method using a printing apparatus that can be connected to a communications line, comprising:

a step of attaching at least one of an ink container for containing ink, a printing medium that is capable of being printed with the ink in the ink container, and a print head for ejecting ink onto the printing medium to a main unit of the printing apparatus together with a memory, wherein an acquisition program for acquiring, via the communications line, a print control program for printing on the printing medium by causing ink to eject from said print head based on image data, is stored on said memory;

a step of said main unit of said printing apparatus reading out said acquisition program from said memory; and a step of acquiring a print control program through said acquisition program that has been read out.

12. A printing apparatus, comprising:

an ink container for containing ink;

a printing medium that is capable of being printed with ink in said ink container; and a print head for ejecting ink onto the printing medium; wherein, at least one of said ink container, said printing medium, and said print head can be attached to and removed from a main unit of the printing apparatus unit together with a memory, and a print control program for printing on said printing medium by causing ink to eject from said print head based on image data, is stored on said memory, and said print control program is a program for performing raster-row conversion processing.

13. A printing apparatus, comprising:

an ink container for containing ink;

a printing medium that is capable of being printed with ink in said ink container; and a print head for ejecting ink onto the printing medium; wherein, at least one of said ink container, said printing medium, and said print head can be attached to and removed from a main unit of the printing apparatus unit together with a memory, a print control program for printing on said printing medium by causing ink to eject from said print head based on image data, is stored on said memory, and said print control program is a program for performing rasterization processing.

14. A printing apparatus, comprising:

an ink container for containing ink;

a printing medium that is capable of being printed with ink in said ink container; and a print head for ejecting ink onto the printing medium; wherein, at least one of said ink container, said printing medium, and said print head can be attached to and removed from a main unit of the printing apparatus unit together with a memory, a print control program for printing on said printing medium by causing ink to eject from said print head based on image data, is stored on said memory, and if said memory is provided in or on the ink container, then said print control program is a program that matches a tendency of the ink contained in said ink container to blot.

15. A printing apparatus, comprising:

an ink container for containing ink;

a printing medium that is capable of being printed with ink in said ink container; and a print head for ejecting ink onto the printing medium; wherein, at least one of said ink container, said printing medium, and said print head can be attached to and removed from a main unit of the printing apparatus unit together with a memory, a print control program for printing on said printing medium by causing ink to eject from said print head based on image data, is stored on said memory, and if said memory is provided in or on the printing medium, then said print control program is a program that matches a coefficient of friction or an ability to absorb ink of the printing medium.

16. A printing apparatus, comprising:

an ink container for containing ink;

a printing medium that is capable of being printed with ink in said ink container; and a print head for ejecting ink onto the printing medium; wherein, at least one of said ink container, said printing medium, and said print head can be attached to and removed from a main unit of the printing apparatus unit together with a memory, a print control program for printing on said printing medium by causing ink to eject from said print head based on image data, is stored on said memory, and if said memory is provided in or on said print head, then said print control program is a program that matches a number of ink-ejecting sections provided in the print head or a distance between the ink-ejecting sections.

17. A printing apparatus, comprising:

an ink container for containing ink;

a printing medium that is capable of being printed with ink in said ink container; and a print head for ejecting ink onto the printing medium; wherein, at least one of said ink container, said printing medium, and said print head can be attached to and removed from a main unit of the printing apparatus unit together with a memory, a print control program for printing on said printing medium by causing ink to eject from said print head based on image data, is stored on said memory, and at least two of said ink container, said printing medium, and said print head are attachable/removable together with memories provided in or on each of the two, unit information for identifying the unit in or on which the memory is provided is stored on each said memory, and by referring to a suitability data table indicating suitability between each of the units, one of said print control programs is specified based on the unit information.

18. A printing method, comprising:

a step of attaching at least one of an ink container for containing ink, a printing medium that is capable of being printed with the ink in the ink container, and a print head for ejecting ink onto the printing medium to a main unit of the printing apparatus together with a memory, wherein a print control program for printing on the printing medium by causing ink to eject from said print head based on image data, is stored on said memory;

a step of said main unit of said printing apparatus reading out said print control program from said memory; and a step of printing using said print control program that has been read out.

* * * * *